US011459838B2

(12) United States Patent
Li et al.

(10) Patent No.: US 11,459,838 B2
(45) Date of Patent: Oct. 4, 2022

(54) LOST CIRCULATION FABRIC, METHOD, AND DEPLOYMENT SYSTEMS

(71) Applicant: Saudi Arabian Oil Company, Dhahran (SA)

(72) Inventors: Bodong Li, Dhahran (SA); Jothibasu Ramasamy, Dammam (SA); Chinthaka Pasan Gooneratne, Dhahran (SA); Guodong Zhan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 25 days.

(21) Appl. No.: 16/897,794

(22) Filed: Jun. 10, 2020

(65) Prior Publication Data

US 2021/0388683 A1 Dec. 16, 2021

(51) Int. Cl.

| | |
|---|---|
| ***E21B 43/10*** | (2006.01) |
| ***E21B 21/00*** | (2006.01) |
| ***E21B 43/04*** | (2006.01) |

(52) U.S. Cl.

CPC ..... *E21B 21/003* (2013.01); *E21B 43/04* (2013.01); *E21B 43/10* (2013.01)

(58) Field of Classification Search

CPC ..... E21B 21/003; E21B 43/10

See application file for complete search history.

(56) References Cited

U.S. PATENT DOCUMENTS

| | | | |
|---|---|---|---|
| 2,927,775 | A | 3/1960 | Hildebrandt |
| 3,028,915 | A | 4/1962 | Jennings |
| 3,102,599 | A | 9/1963 | Hillbum |
| 3,656,564 | A | 4/1972 | Brown |
| 4,064,211 | A | 12/1977 | Wood |
| 4,191,493 | A | 3/1980 | Hansson et al. |
| 4,365,677 | A | 12/1982 | Owens |
| 4,464,993 | A | 8/1984 | Porter |
| 4,501,337 | A | 2/1985 | Dickinson et al. |

(Continued)

FOREIGN PATENT DOCUMENTS

| | | |
|---|---|---|
| CN | 108240191 | 7/2018 |
| EP | 3034778 | 6/2016 |

(Continued)

OTHER PUBLICATIONS

PCT International Search Report and Written Opinion in International Appln. No. PCT/US2020/064206, dated Apr. 1, 2021, 14 pages.

(Continued)

*Primary Examiner* — Catherine Loikith

(74) *Attorney, Agent, or Firm* — Fish & Richardson P.C.

(57) ABSTRACT

A lost circulation system and a method for reducing losses of drilling fluid in a lost circulation zone of a wellbore. The lost circulation system includes a sheet of lost circulation fabric and particles of a second lost circulation material. The sheet of lost circulation fabric is a material whose structure and composition limit a flow of fluids, particularly drilling fluid, through the sheet. The sheet of lost circulation material has a maximum thickness of 1 millimeter, a length of one foot to one thousand feet, and a width of one inch to twenty inches. The sheet of the lost circulation fabric has holes extending through the sheet.

9 Claims, 18 Drawing Sheets

(56) References Cited

U.S. PATENT DOCUMENTS

| | | | | |
|---|---|---|---|---|
| 5,388,648 | A | 2/1995 | Jordan, Jr. | |
| 5,429,198 | A | 7/1995 | Anderson et al. | |
| 5,501,248 | A | 3/1996 | Kiest, Jr. | |
| 5,803,666 | A | 9/1998 | Keller | |
| 5,853,049 | A | 12/1998 | Keller | |
| RE36,362 | E | 11/1999 | Jackson | |
| 6,012,526 | A | 1/2000 | Jennings et al. | |
| 6,170,531 | B1 | 1/2001 | Jung et al. | |
| 6,371,306 | B2 * | 4/2002 | Adams | B01D 29/012 210/388 |
| 6,561,269 | B1 | 5/2003 | Brown et al. | |
| 6,637,092 | B1 | 10/2003 | Menzel | |
| 7,387,174 | B2 | 6/2008 | Lurie | |
| 7,455,117 | B1 | 11/2008 | Hall et al. | |
| 7,789,148 | B2 | 9/2010 | Rayssiguier et al. | |
| 8,176,977 | B2 | 5/2012 | Keller | |
| 8,567,491 | B2 | 10/2013 | Lurie | |
| 9,470,059 | B2 | 10/2016 | Zhou | |
| 9,757,796 | B2 | 9/2017 | Sherman et al. | |
| 9,903,010 | B2 | 2/2018 | Doud et al. | |
| 9,976,381 | B2 | 5/2018 | Martin et al. | |
| 10,233,372 | B2 | 3/2019 | Ramasamy et al. | |
| 10,352,125 | B2 | 7/2019 | Frazier | |
| 2002/0040812 | A1 | 4/2002 | Heying et al. | |
| 2003/0159776 | A1 | 8/2003 | Graham | |
| 2006/0185843 | A1 | 8/2006 | Smith | |
| 2007/0017669 | A1 | 1/2007 | Lurie | |
| 2009/0178809 | A1 | 7/2009 | Jeffryes et al. | |
| 2009/0183875 | A1 | 7/2009 | Rayssiguier et al. | |
| 2009/0255689 | A1 | 10/2009 | Kriesels et al. | |
| 2010/0175882 | A1 | 7/2010 | Bailey et al. | |
| 2011/0120732 | A1 | 5/2011 | Lurie | |
| 2011/0220350 | A1 | 9/2011 | Daccord et al. | |
| 2011/0220416 | A1 | 9/2011 | Rives | |
| 2012/0111578 | A1 | 5/2012 | Tverlid | |
| 2013/0299241 | A1 | 11/2013 | Alberty et al. | |
| 2014/0158369 | A1 | 6/2014 | Radford et al. | |
| 2014/0231068 | A1 | 8/2014 | Isaksen | |
| 2015/0020908 | A1 | 1/2015 | Warren | |
| 2015/0159467 | A1 | 6/2015 | Hartman et al. | |
| 2016/0160106 | A1 | 6/2016 | Jamison et al. | |
| 2017/0175446 | A1 | 6/2017 | Fraser et al. | |
| 2018/0010030 | A1 | 1/2018 | Ramasamy et al. | |
| 2018/0086962 | A1 * | 3/2018 | Amanullah | E21B 21/003 |
| 2018/0326679 | A1 | 11/2018 | Weisenberg et al. | |
| 2019/0049054 | A1 | 2/2019 | Gunnarsson et al. | |
| 2019/0194519 | A1 | 6/2019 | Amanullah | |
| 2019/0257180 | A1 | 8/2019 | Kriesels et al. | |
| 2019/0323332 | A1 | 10/2019 | Cuellar et al. | |
| 2021/0172269 | A1 | 6/2021 | Li et al. | |
| 2021/0172270 | A1 | 6/2021 | Li et al. | |
| 2021/0172281 | A1 | 6/2021 | Li et al. | |

FOREIGN PATENT DOCUMENTS

| | | |
|---|---|---|
| GB | 2155519 | 9/1985 |
| GB | 2357305 | 6/2001 |
| GB | 2466376 | 6/2010 |
| GB | 2484166 | 4/2012 |
| WO | 03/042494 | 5/2003 |
| WO | 2019027830 | 2/2019 |

OTHER PUBLICATIONS

PCT International Search Report and Written Opinion in International Appln. No. PCT/US2020/064210, dated Apr. 1, 2021, 15 pages.

PCT International Search Report and Written Opinion in International Appln. No. PCT/US2020/064213, dated Apr. 1, 2021, 14 pages.

Corona et al., "Novel Washpipe-Free ICD Completion With Dissolvable Material," OTC-28863-MS, presented at the Offshore Technology Conference, Houston, TX, Apr. 30-May 3, 2018; 2018, OTC, 10 pages.

gryphonoilfield.com [online], "Gryphon Oilfield Services, Echo Dissolvable Fracturing Plug," available on or before Jun. 17, 2020, retrieved on Aug. 20, 2020, retrieved from URL <https://www.gryphonoilfield.com/wp-content/uploads/2018/09/Echo-Series-Dissolvable-Fracturing-Plugs-8-23-2018-1.pdf>, 1 page.

Takahashi et al., "Degradation study on materials for dissolvable frac plugs," URTeC 2901283, presented at the Unconventional Resources Technology Conference, Houston, Texas, Jul. 23-25, 2018, 9 pages.

tervesinc.com [online], Tervalloy™ Degradable Magnesium Alloys, available on or before Jun. 12, 2016, via Internet Archive: Wayback Machine URL <https://web.archive.org/web/20160612114602/http://tervesinc.com/media/Terves_8-Pg_Brochure.pd>, retrieved on Aug. 20, 2020, <http://tervesinc.com/media/Terves_8-Pg_Brochure.pdf>. 8 pages.

PCT International Search Report and Written Opinion in International Appln. No. PCT/US2020/064215, dated Mar. 15, 2021, 13 pages.

PCT International Search Report and Written Opinion in International Appln. No. PCT/US2020/064220, dated Mar. 15, 2021, 15 pages.

edition.cnn.com [online], "Revolutionary gel is five times stronger than steel," retrieved from URL <https://edition.cnn.com/style/article/hydrogel-steel-japan/index.html>, retrieved on Aug. 6, 2020, available on or before Jul. 16, 2017, 6 pages.

Halliburton, "Drill Bits and Services Solutions Catalogs," retrieved from URL: <https://www.halliburton.com/content/dam/ps/public/sdbs/sdbs_contents/Books_and_Catalogs/web/DBS-Solution.pdf> on Sep. 26, 2019, Copyright 2014, 64 pages.

nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.

wikipedia.org [online], "Surface roughness," retrieved from URL <https://en.wikipedia.org/wiki/Surface_roughness> retrieved on Apr. 2, 2020, available on or before Oct. 2017, 6 pages.

Zhang et al, "Increasing Polypropylene High Temperature Stability by Blending Polypropylene-Bonded Hindered Phenol Antioxidant," Macromolecules, 51(5), pp. 1927-1936, 2018, 10 pages.

International Search Report and Written Opinion issued in International Application No. PCT/US2018/044095 dated Nov. 29, 2018, 14 pages.

PCT International Search Report and Written Opinion in International Appln. No. PCT/US2020/064195, dated Feb. 26, 2021, 14 pages.

PCT International Search Report and Written Opinion in International Appln. No. PCT/US2020/064198, dated Feb. 22, 2021, 13 pages.

PCT International Search Report and Written Opinion in International Appln. No. PCT/US2020/064203, dated Feb. 23, 2021, 14 pages.

PCT International Search Report and Written Opinion in International Appln. No. PCT/US2020/064219, dated Mar. 9, 2021, 13 pages.

U.S. Appl. No. 16/831,426, Li et al., filed Mar. 26, 2020.

U.S. Appl. No. 16/831,483, Li et al., filed Mar. 26, 2020.

U.S. Appl. No. 16/831,559, Li et al., filed Mar. 26, 2020.

U.S. Appl. No. 16/897,801, Li et al., filed Jun. 10, 2020.

U.S. Appl. No. 16/897,805, Li et al., filed Jun. 10, 2020.

GCC Examination Report issued in Gulf Cooperation Council Appln. No. 2020-41056, dated Dec. 6, 2021, 4 pages.

GCC Examination Report issued in Gulf Cooperation Council Appln. No. 2020-41086, dated Nov. 30, 2021, 4 pages.

* cited by examiner

LOST CIRCULATION FABRIC, METHOD, AND DEPLOYMENT SYSTEMS

TECHNICAL FIELD

This disclosure relates to materials, methods, and systems for treating lost circulation zones in a wellbore.

BACKGROUND OF THE DISCLOSURE

In drilling operations, a drilling fluid is circulated through a drill string in a wellbore and then back to the earth surface to aid in drilling, such as to remove cuttings from the wellbore and cool the drill bit. The drilling fluid can be collected at the surface, reconditioned and reused. In the wellbore, the drilling fluid can also be used to maintain a predetermined hydrostatic pressure. However, drilling fluid can be lost into the formation during drilling, such as from seepage of the drilling fluid into the formation, resulting in what is commonly known as "lost circulation."

Lost circulation is a major cause of lost time or non-productive time (NPT) during drilling and increases the cost of drilling to replace expensive drilling fluid (which can also be referred to as drilling mud) lost into the formation. In addition to NPT and adding more cost to drilling, lost circulation can lead to a quick drop of the mud column in the wellbore, which can be a starting point to various drilling problems such as kick, a blowout, borehole collapse, or pipe sticking, leading to side tracking or abandonment of a well.

The main sources of seepage to moderate loss of drilling fluid are high permeable, super-permeable, fissured, and fractured formations. In addition to natural loss zones, there is a possibility of having induced loss zones while drilling subsurface formations with a narrow mud weight window such as weak and unconsolidated formations, depleted formations, high pressure zones, etc. Loss zones can be induced, for example, when the mud weight needed for well control and borehole stability exceeds the fracture gradient of the formations.

SUMMARY

The present disclosure relates to a lost circulation fabric (LCF), methods of remediating a lost circulation zone in a wellbore with LCF and a slurry of lost circulation material (LCM), and systems and methods for emplacing lost circulation fabric around a wall of a selected section of a wellbore. LCF can be applied to selected areas of the wellbore to reduce loss of circulation of drilling fluid into the formation, for example, when drilling in a highly fractured or porous formation.

Implementations of the present disclosure include a lost circulation system configured to reduce losses of drilling fluid in a lost circulation zone of a wellbore. The system includes a sheet of a lost circulation fabric and particles of a second lost circulation material. The sheet of the lost circulation fabric is a material whose structure and composition limit the flow of drilling fluid through the sheet. The sheet of lost circulation material has a maximum thickness of 1 millimeter, a length of one foot to one thousand feet, and a width of one inch to twenty inches. The sheet of the lost circulation fabric defines holes extending through the sheet.

In some implementations, the sheet is formed of material having an elastic modulus between 1300 to 2000 MPa, a tensile strength between 10 and 10,000 megapascals (MPa), a surface roughness between 0.025 micrometers to 1 millimeter of 1% loss/° C. starting at 350° C., a toughness between 1 and 100 kilojoules per square meter (kJ/m$^2$), and a thermal stability of 1% loss/° C. starting at 350° C.

In some implementations, the sheet is a polymeric membrane.

In some implementations, the sheet includes openings each opening having a major dimension K between 0.005 millimeters to 5 millimeters, the openings having a spacing S between adjacent openings of between 0.0025 millimeters and fifty millimeters.

In some implementations, the sheet is a fabric woven from threads a first material and a second material.

In some implementations, the composite of the first material is a polymer and the second material is a polymer.

In some implementations, the first material is a polymer and the second material is non-polymer.

In some implementations, the sheet includes a first strip of fabric material, a second strip fabric material proximal and parallel to the first strip, a third fabric strip interwoven between first fabric strip and the second fabric strip, and a fourth fabric strip interwoven between the first fabric strip and the second fabric strip, parallel to the third fabric strip, and interwoven opposite the third fabric strip.

In some implementations, first fabric is spaced from the second fabric and the third fabric is spaced from the second fabric by a first spacing K between 0.005 millimeters and 5 millimeters.

In some implementations, the first fabric, the second fabric, the third fabric, and the fourth fabric have a width W between 0.0025 millimeters and fifty millimeters.

Further implementations of the present disclosure include a lost circulation system configured to reduce losses of drilling fluid in a lost circulation zone of a wellbore. The system includes a sheet of a first lost circulation material suitable for deployment in a wellbore and particles of a second lost circulation material. The particles of a second lost circulation material include marble particles, calcium carbonate flakes, date palm tree fibers, and date seed particles.

In some implementations, the marble particles have a characteristic size between one millimeter and five millimeters.

In some implementations, the calcium carbonate flakes have a characteristic size between one millimeter and five millimeters.

In some implementations, the date palm tree fibers have a characteristic size between one millimeter and five millimeters.

In some implementations, the date seed particles have a characteristic size between one millimeter and five millimeters.

In some implementations, the sheet includes openings. Each opening has a major dimension K between 0.005 millimeters to 5 millimeters. The openings have a spacing S between adjacent openings of between 0.0025 millimeters and fifty millimeters.

In some implementations, the sheet is a fabric woven from threads a first material and a second material.

In some implementations, the sheet includes a first strip of fabric material, a second strip fabric material proximal and parallel to the first strip, a third fabric strip interwoven between first fabric strip and the second fabric strip, and a fourth fabric strip interwoven between the first fabric strip and the second fabric strip, parallel to the third fabric strip, and interwoven opposite the third fabric strip.

In some implementations, the first fabric is spaced from the second fabric and the third fabric is spaced from the second fabric by a first spacing K between 0.005 millimeters and 5 millimeters.

In some implementations, the first fabric, the second fabric, the third fabric, and the fourth fabric have a width W between 0.0025 millimeters and fifty millimeters.

Other aspects and advantages of this disclosure will be apparent from the following description made with reference to the accompanying drawings and the appended claims.

DETAILED DESCRIPTION

The present disclosure relates to a lost circulation fabric (LCF), methods of remediating a lost circulation zone in a wellbore with LCF and a slurry of lost circulation material (LCM), and a system and method for emplacing lost circulation fabric around a wall of a selected section of a wellbore. LCF can be applied to selected areas of the wellbore to reduce loss of circulation of drilling fluid into the formation, for example, when drilling in a highly fractured or porous formation.

Lost circulation can occur when drilling formations with natural or induced fractures, which result in spaces for drilling fluid (e.g., water- or oil-based mud) to flow into, causing a partial or total loss of the drilling fluid. By covering areas of fractures or other high porosity conditions along a wellbore with LCF, drilling fluid can be prevented or inhibited from flowing into the LCF-covered section of the wellbore formation, thereby reducing the amount of lost circulation. Lost circulation fabric can be applied to a lost circulation zone in conjunction with a slurry of lost circulation material.

The methods of applying LCF to a wellbore wall can include sending the LCF deployment tool down the wellbore to a location downstream (farther down the wellbore) of a selected section of the wellbore to be covered with the LCF. Once in position, the LCF deployment tool can apply the LCF to cover the selected section of the wellbore wall. LCF can be partially retained by having a first end of the LCF attached to a retention mechanism of the LCF deployment tool or the wellbore, while a second end of the LCF is moved over the selected section of the wellbore wall. After allowing fluid with a slurry of lost circulation material to circulate from downhole of the LCF deployment tool uphole past the selected section of the wellbore for a time period sufficient to allow the released portion of the LCF to cover the selected section of the wellbore, the LCF deployment tool can be removed.

Figure 1:
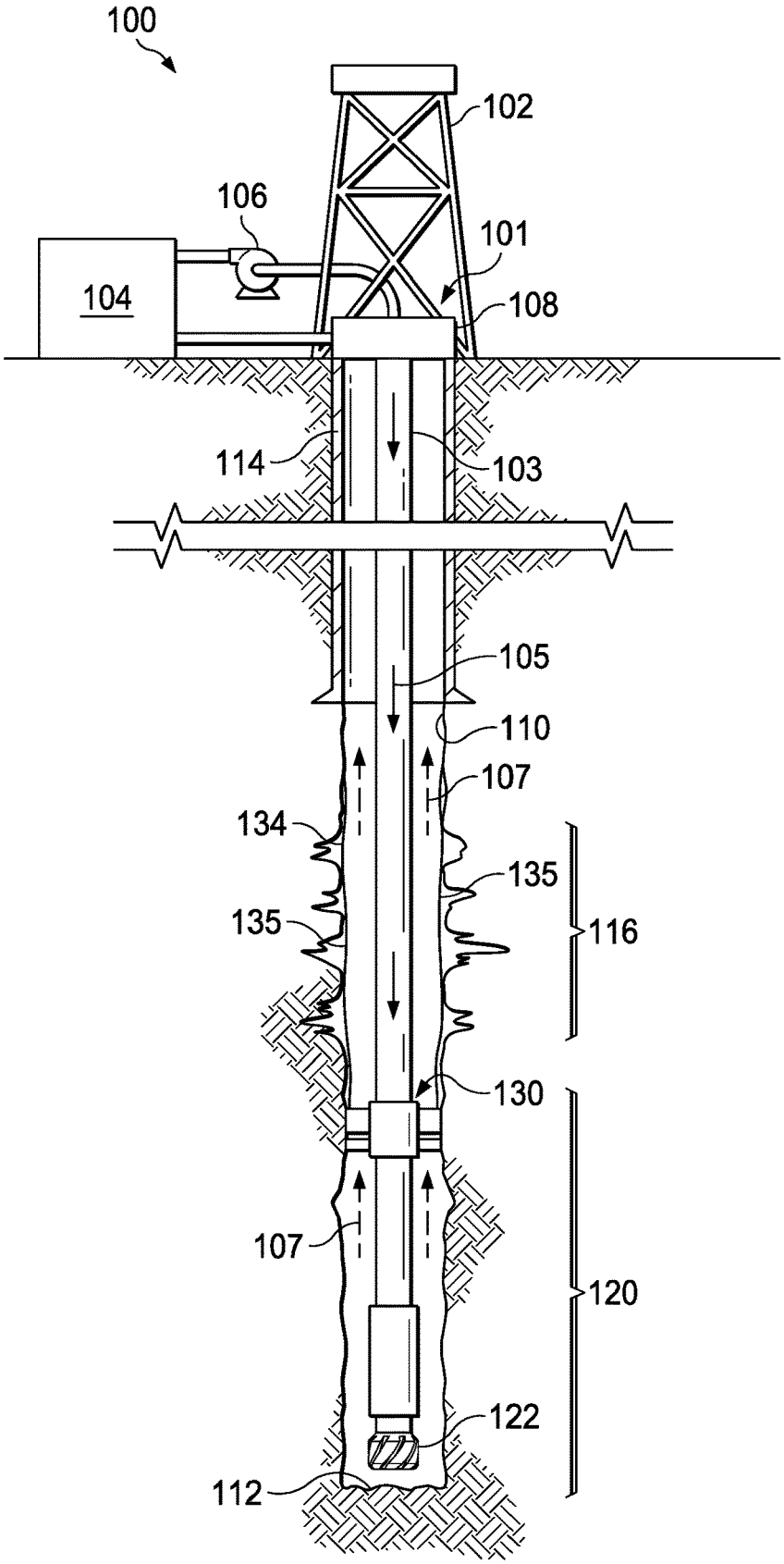
FIG. 1 is a schematic view of a lost circulation zone of a wellbore with a lost circulation fabric disposed in the lost circulation zone.

FIG. 1 shows an example of a wellbore with a lost circulation zone with a system for applying LCF fabric to a selected section of a wellbore wall disposed in the wellbore. The LCF application method can be performed during a drilling operation 100 as schematically shown in FIG. 1. At the surface of a well 101, the drilling operation 100 includes a rig 102 with drilling equipment (e.g., drill pipe, kelly drive, swivel, mud hose, etc.) for drilling a wellbore 110, one or more mud tanks 104 (or mud pit(s)), one or more mud pumps 106, a blowout preventer 108, and pipes and valves for fluidly connecting and controlling the drilling fluid system for drilling the wellbore 110. To drill the wellbore 110, a bottom hole assembly (BHA) 120 connected at an end of a string of drill pipe 103 with a drill bit 122. The drill bit 122 is rotated against the bottom 112 of the wellbore 110 while drilling fluid is flowed downhole 105 through the drill pipe 103, out the BHA 120, and then returned 107 to the surface of the well 101. As new sections of wellbore 110 are drilled, upper sections (sections of the wellbore closer to the surface of the well) of the wellbore 110 can be cased with a casing 114.

Referring to FIG. 1, the LCF deployment tool 130 can be provided along the BHA 120 or around a section of drill pipe 103 proximate the BHA 120. LCF 135 is deployed from the LCF deployment tool 130 to cover the lost circulation zone 116.

The drilling equipment shown in the drilling operation of FIG. 1 is representative of an exemplary drilling operation 100. However, other known drilling equipment not shown can be used to drill a wellbore 110 without departing from the scope of this disclosure. For example, when a wellbore is being drilled at the sea floor, offshore drilling equipment (e.g., risers, platforms, trees, etc.) can be used. Further, these methods can be used while drilling vertical or directional wells.

Lost circulation is a major challenge in drilling operations by causing partial or total loss of drilling fluids. Lost circulation also represents financial loss due to the non-productive time and extra cost on the drilling fluid to maintain the fluid level in the annulus between the drill string and wellbore. In severe lost circulation cases, the flowing of mud in the loss zone and resulting pressure drop on the open formation can compromise the well control and cause catastrophic results. By using these methods and apparatuses, moderate and severe lost circulation can be reduced or stopped, for example, by covering the severe loss zone with LCF or by a combination of covering the severe loss zone with LCF and circulating a lost circulation slurry around the applied LCF.

Figure 2:
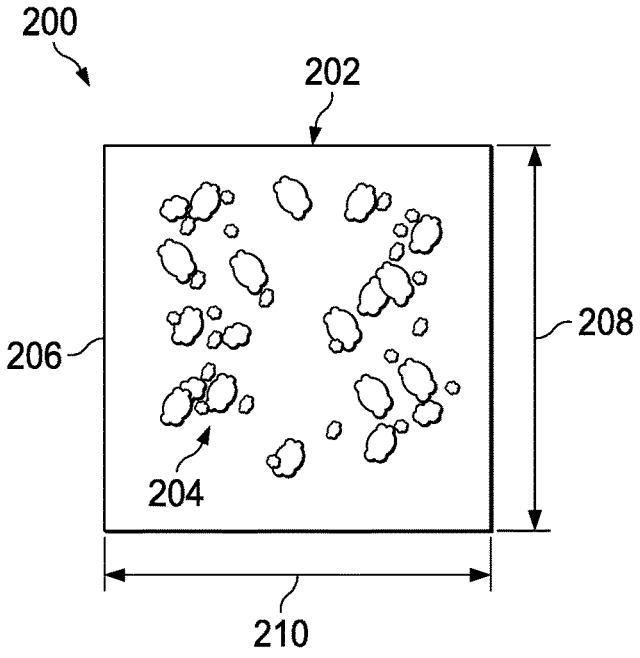
FIG. 2 is a schematic view of a single sheet lost circulation fabric of FIG. 1.

FIG. 2 shows a lost circulation system 200 to reduce losses of drilling fluid in a lost circulation zone 116 of a wellbore 110. The lost circulation system 200 includes a sheet of a first lost circulation material 202 and particles of a second lost circulation material 204. Sheets of the first lost circulation material 202 are broad, flat pieces of material and provide an underlying structure to cover portions of a lost circulation zone and limit flow into the lost circulation zone.

The sheet of the first lost circulation material 202 has a thickness 206. The maximum thickness 206 is 1 millimeter. The sheet of the first lost circulation material 202 has a length 208. The length of the sheet of the first lost circulation material 202 is between one foot and 1000 feet (e.g., one foot, 5 feet, 10 feet, 20 feet, 50 feet, 100 feet, and 500 feet). The sheet of the first lost circulation material 202 has a width 210. The width 210 of the sheet of the first lost circulation material 202 is between one inch and twenty inches (e.g., one inch, 4 inches, 10 inches, and 20 inches). The sheet of the lost circulation material 202 has a length-to-thickness ratio of between 305 and 305000. The sheet of the lost circulation material 202 has a width-to-thickness ratio between 25 and 500.

The sheet of the lost circulation material 202 is formed of material having an elastic modulus between 1300 and 2000 mega pascals (MPa). The sheet of lost circulation material 202 has a tensile strength between 10 and 10,000 MPa. The tensile strength for typical polypropylene fabric used as LCF is 28-36 MPa. The tensile strength of the fabric is a measurement of the maximum force that can be applied to the fabric without breaking or tearing. Tensile strength of a fabric can be measured by a strip test where a sample of the fabric is gripped on opposing ends of the sample of the fabric. A force is applied longitudinally until the fabric ruptures. Testing of the tensile strength of a fabric can be conducted in accordance with textile industry standards. For example, ASTM International D5035 Standard Test for Breaking Force and Elongation of Textile Fabrics (Strip Method) provides procedures for measuring tensile strength of the fabric.

The sheet of the lost circulation material 202 is formed of material having a surface roughness ($R_a$) between 0.025 micro millimeters and 1 millimeter. Surface roughness is a component of the surface texture. The surface roughness of a fabric is a measurement of the amplitude and frequency of deviation from a mean surface. The surface roughness (Ra) is the arithmetic average of the absolute values in the roughness profile of the fabric. Another component of surface roughness is the arithmetic mean height ($S_a$). The arithmetic mean height (Sa) of the scale limited surface that describes surface roughness level in the asperity direction. A ratio of the steepness of the asperity of the rough surface is defined by $R_a/S_a$. The ratio $R_a/S_a$ is between 0.1 to 1000. A sheet of the lost circulation material with surface roughness between 0.025 micro millimeters and 1 millimeter will result in a friction force that is able to better "grab" the wellbore 110 and the particles of a second lost circulation material 204.

The sheet of the lost circulation material 202 is formed of material having a toughness between 1 and 100 kilojoules per square meter (kJ/m$^2$). The toughness of a fabric is the measurement of the fabrics ability to absorb energy without failing. The absorbed energy is measured during tensile strength testing.

The sheet of the lost circulation material 202 is formed of thermally stable material having the following properties: a softening point between 140-150° C., a melting point at 166° C., and starts to lose weight sharply from 100% at 350° C. to 0% at 450° C. The thermal stability of the fabric is a measurement of the ability of the fabric to withstand breaking down when exposed to heat (% loss/° C.). Testing of the thermal stability of a fabric can be conducted in accordance with textile industry standards. For example, ASTM International E2550 Standard Test for Thermal Stability by Thermogravimetry provides procedures for measuring thermal stability of the fabric.

The sheet of the lost circulation material 202 can be a membrane. A membrane is a thin layer of material that is a selective barrier which stops some things (for example, particles or ions), but allows other larger things to pass through. The membrane can be a polymeric membrane. A polymeric material, such as a polymer or a fiber-reinforced polymer is flexible, yet tough and abrasion resistant. For example, the sheet of the lost circulation material 202 can be made of polypropylene, polyethylene, or an aramid (like Kevlar or Twaron). The sheet of the lost circulation material 202 be porous, however the sizing of the pores in the fabric can be such that the second lost circulation material 204, otherwise lost through a large pore size lost circulation zone 116, can accumulate on the fabric, forming an filter cake to impede fluid leakage on the sheet of the lost circulation material 202.

The filter cake can be formed over the applied sheet of the lost circulation material 202 to further reduce and/or inhibit lost circulation. The filter cake is formed over one or more applied sheet of the lost circulation material 202 by sending the second lost circulation material 204 downhole into the wellbore 110 after the sheet of the lost circulation material 202 has been applied. The differential pressure from the selected and covered lost circulation section 116 of the wellbore 110 and the circulation drilling fluid (or mud column) can press the loss circulation material 202 along the applied sheet of the lost circulation material 202, where accumulation of the lost circulation material 202 on the applied sheet of the lost circulation material 202 forms the filter cakes.

The particles of the second lost circulation material 204 of the lost circulation system 200 can include soda ash, bentonite, caustic soda, date seeds, and marble. The particles of the lost circulation material 204 can contain different types of particulates, fibers and flakes. Particulates can vary in size between 5 micrometer and 3 millimeter. A mixture or blend of lost circulation material 204 of different sizes is typically used to form a more effective bridge across the loss zone. Larger particles are less likely to flow through holes or gaps in the first lost circulation material. As the larger particles collect, they form a bridging structure that can trap smaller particles that would otherwise flow through the holes or gaps in the first lost circulation material. The smaller particles can limit fill and limit flow through spaces between the larger particles. The particles of the second lost circulation material 204 of the lost circulation system 200 can be mixed with a liquid to form a slurry. For example, the liquid can be water or oil.

This approach was tested in a laboratory. In a first test, the lost circulation slurry from Table 1 was placed inside a container having multiple 6 mm wide slots, and 500 psi pressure was applied.

TABLE 1

Slurry components

| LCM slurry components | Amount |
|---|---|
| Fresh Water | 339.8 (cc) |
| Soda Ash ($Na_2CO_3$) | 0.5 gm |
| Bentonite | 25 gm |
| Caustic Soda (NaOH) | 0.5 gm |
| ARC Plug Admix | 15 (cc) |

TABLE 1-continued

| Slurry components | |
|---|---|
| LCM slurry components | Amount |
| ARC Plug F | 10 (cc) |
| Sure Seal ™ | 10 (cc) |
| Marble F | 15 (cc) |
| Marble C | 10 (cc) |
| Marble M | 10 (cc) |
| Baracarb-50 ® | 15 (cc) |
| Soluflake M ™ | 15 (cc) |

When the pressure was applied, no resistance by the slurry was shown to bridge the slots, and all the slurry was lost in less than a minute. In a second test, the slots of the container were first covered with polypropylene LCF, and the lost circulation slurry from Table 1 was placed over the LCF. A pressure of 500 psi was then applied. Initially after applying the pressure, some fluid loss was shown, but soon stopped as the bridging materials in the lost circulation slurry and the LCF worked in synergy to minimize initial losses of 22 ml and stopped any further losses. The results of the tests in the study are shown below in Table 2.

Table 1. Slurry components describes the slurry mixture additives and amounts for an example slurry mixture. Fresh water is used as the solvent in the solution. Sodium carbonate (($Na_2CO_3$), commonly known as soda ash, can be used to control calcium concentrations in a water-based drilling mud system and to increase drilling mud system pH. Bentonite is an aluminum phyllosilicate clay used as an absorbant which swells in water, and which can be used to plug lost circulation zones. Sodium hydroxide (NaOH), commonly known as caustic soda, can be used to increase the pH of a water-based drilling mud system. ARC Plug Admix is a date seed-based sized particulate LCM that is a mixture of different sizes of ground date seed such as extra coarse, coarse, medium, fine, super fine. Sizes of the particles are ranging from 2830 micron to 149 micron. ARC Plug F is a date seed-based with a fine sized particulate LCM. Sure Seal™ is a granular marble LCM that can be used to increase wellbore fracture initiation and propagation. Crush and ground marble particles have a high compressive strength and can be used to mechanically plug lost circulation zones. Particulates can vary in size between fine (F), medium (M), and coarse (C). Marble F particulate sizes range from 5 to 20 micron. Marble M particulate sizes range from 135 to 165 microns. Marble C particulate sizes range from 550 to 650 microns. Baracarb-50 ® is marble based lost circulation material used as a bridging agent and to increase drilling mud density. Baracarb-50 ® has a nominal median particulate size of 50 microns. Soluflake M™ is a flaked calcium carbonate that can be used as a lost circulation material.

TABLE 2

| Lost circulation test results | | | | | |
|---|---|---|---|---|---|
| Test # | Test Condition | Testing Time | Slots Width | Test Pressure | Total Fluid Loss |
| 1 | Without polypropylene LCF | 30 min | 6 mm | 500 psi | All |
| 2 | With polypropylene LCF | 30 min | 6 mm | 500 psi | 22 ml |

As shown, when using LCF in combination with lost circulation slurry, lost circulation may be controlled in severe loss circulation zones. Further, lost circulation may be significantly reduced when using lost circulation slurry combined with LCF compared to using lost circulation slurry without LCF.

Figure 3:
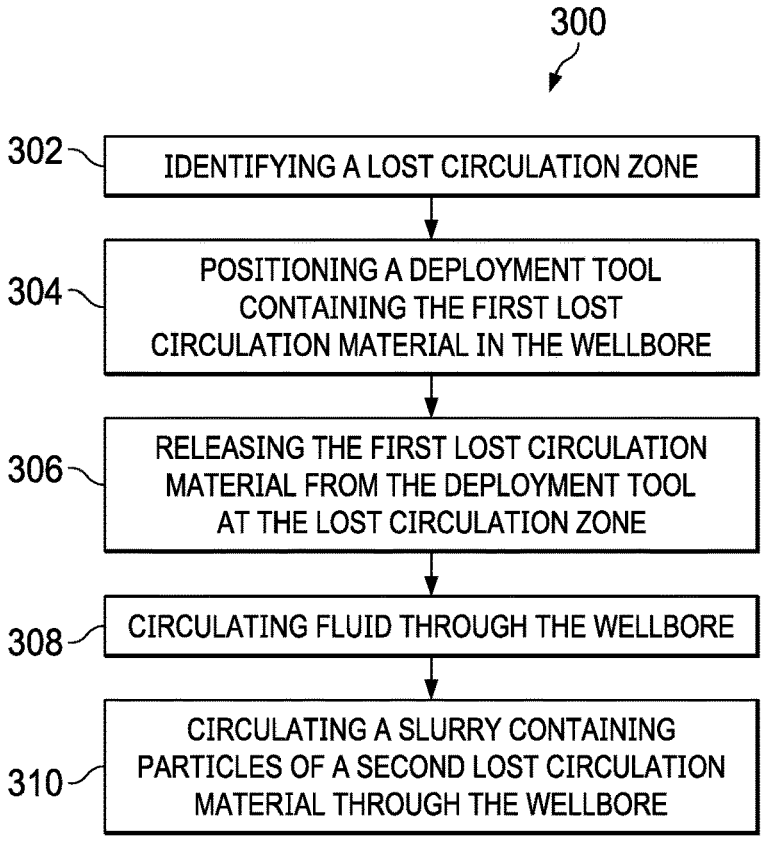
FIG. 3 is a flow chart of an example method of reducing losses with the sheet of lost circulation fabric of FIG. 2.

FIG. 3 shows a method 300 for reducing losses of drilling fluid in a lost circulation zone of a wellbore. At 302, the lost circulation zone is identified. At 304, a deployment tool containing a sheet of a first lost circulation material is positioned in the wellbore at the lost circulation zone. At 306, the first lost circulation material is released from the deployment tool at the lost circulation zone. At 308, a fluid is circulated through the wellbore. At 310, a slurry containing particles of a second lost circulation material is circulated through the wellbore.

Figure 10:
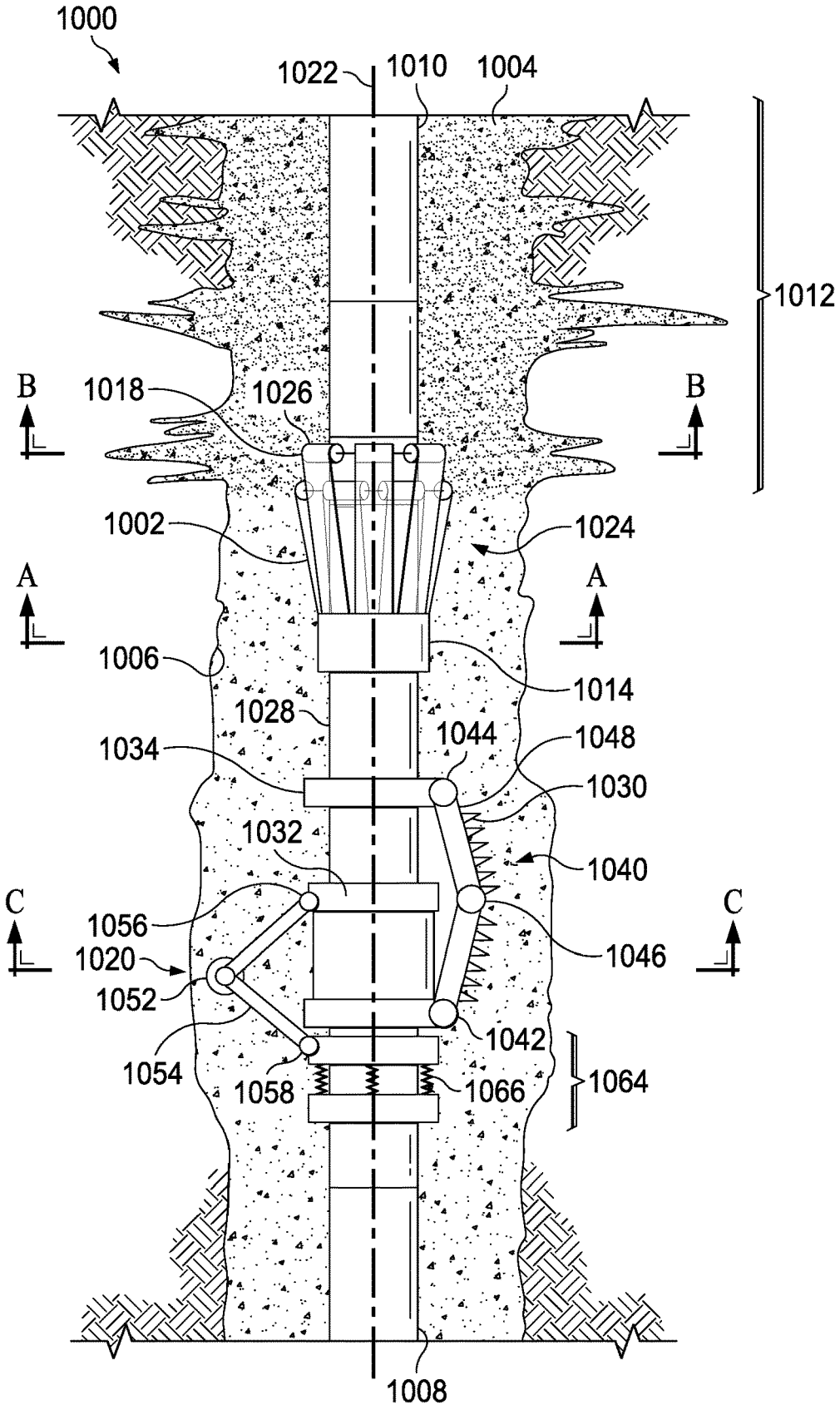
FIG. 10 shows an LCF deployment tool.

Deploying the sheet of the first lost circulation material (404) can include positioning the LCF deployment tool 1000, shown in FIG. 10, containing the first lost circulation material 1002 in the wellbore 1006. Further examples of deployment tools are described in more detail later. After the LCF deployment tool 1000 containing the lost circulation material 1002 is placed in the wellbore, the first lost circulation material 1002 is released from the LCF deployment tool 1000 at the lost circulation zone 1012. Next, a fluid is circulated through the wellbore 1006. Circulating the fluid in the wellbore 1006 can include circulating drilling fluid through the wellbore 1006 after releasing the first lost circulation material 1002 from the LCF deployment tool 1000 at the lost circulation zone 1016 and before circulating the slurry containing particles of the second lost circulation material 1004 through the wellbore 1006.

The lost circulation slurry 1004 can be sent downhole as a mixture with drilling fluid or separately from drilling fluid. Further, lost circulation slurry 1004 can be sent downhole before, during, or after deployment of an LCF 1002 from the LCF deployment tool 1000. For example, lost circulation slurry 1004 can be sent downhole after the LCF deployment tool 1000 is in position below a selected section 1012 of the wellbore, where the lost circulation slurry 1004 can be circulated through the drill string 1010 and wellbore 1006 while LCF 1002 is being deployed from the LCF deployment tool 1000 and/or after the LCF 1002 is completely detached from the LCF deployment tool 1000.

The LCF deployment tool 1000 can include a retention mechanism 1016 retaining a first end of the first lost circulation material 1002. The retention mechanism 1016 can include a housing that contains the lost circulation fabric 1002 prior to partially releasing the lost circulation fabric 1002. Partially releasing the first lost circulation material 1002 includes sending a signal to open a gate of the retention mechanism 1016. A second end of the first lost circulation material 1002 can be wound around a spool 1026. Partially releasing the first lost circulation material 1002 can include sending a signal to radially expand the retention mechanism 1016 to create a radial spacing between the first end of the first lost circulation material 1002 retained by the retention mechanism 1016 and the spool 1026.

Positioning the LCF deployment tool 1000 can include, before the first lost circulation material 1002 is released from the LCF deployment tool 1000 at the lost circulation zone 1012, under reaming a section of the wellbore 1006 and radially expanding a retention mechanism 1016 of the LCF deployment tool 1000 to contact the under reamed section of the wellbore 1006. Positioning the LCF deployment tool 1000 can also include radially expanding at least one roller arm 1020 from the LCF deployment tool 1000, and then after detaching the first lost circulation material 1002 from the LCF deployment tool 1000, rolling a roller 1052 on the at least one roller arm 1054 over the first lost circulation material 1002.

Figure 4:
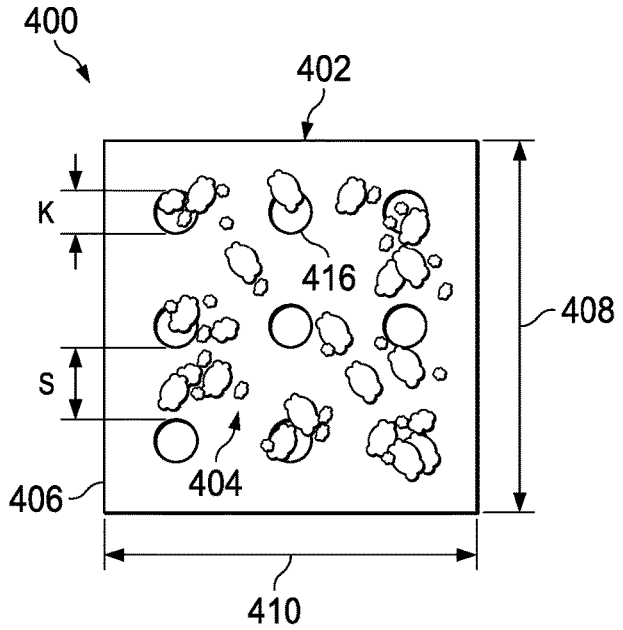
FIG. 4 is a schematic view of a single sheet lost circulation fabric of FIG. 1 with openings.
Figure 5A:
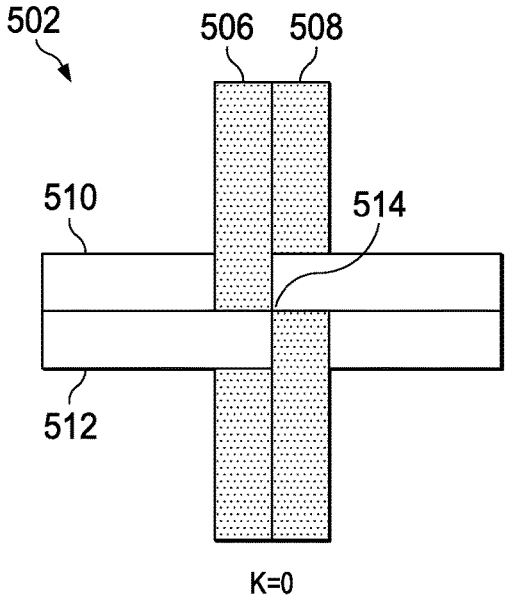
FIG. 5A-5F are schematic views of various woven strip lost circulation fabrics.
Figure 5B:
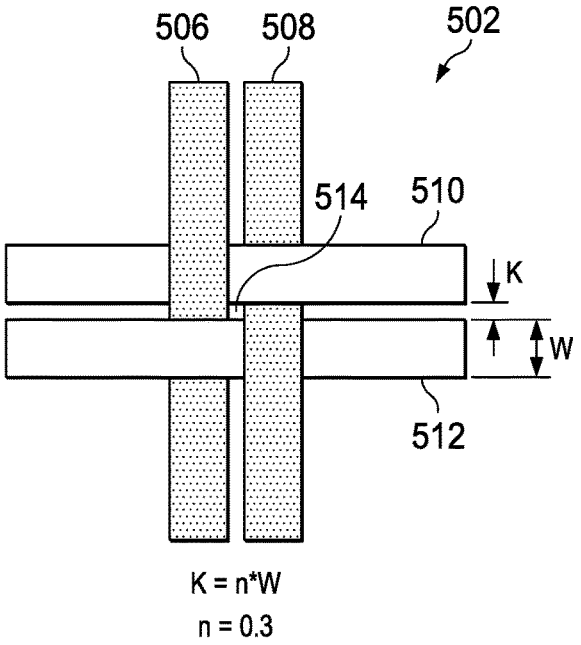
Figure 5C:
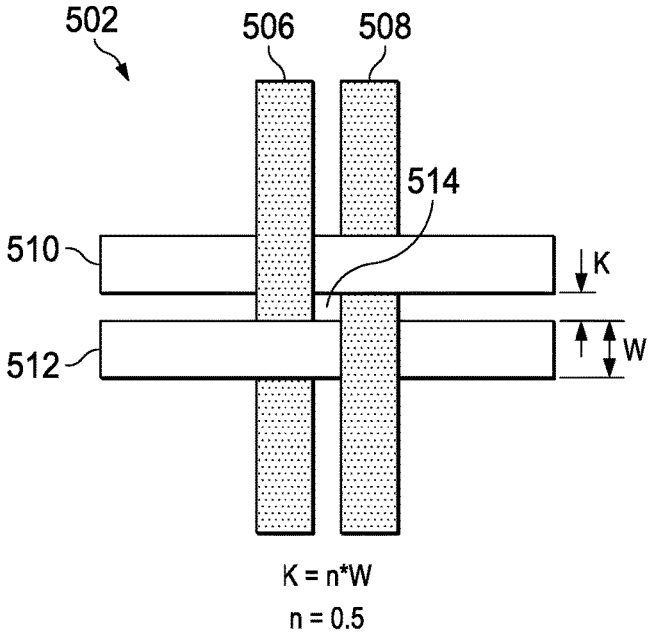
Figure 5D:
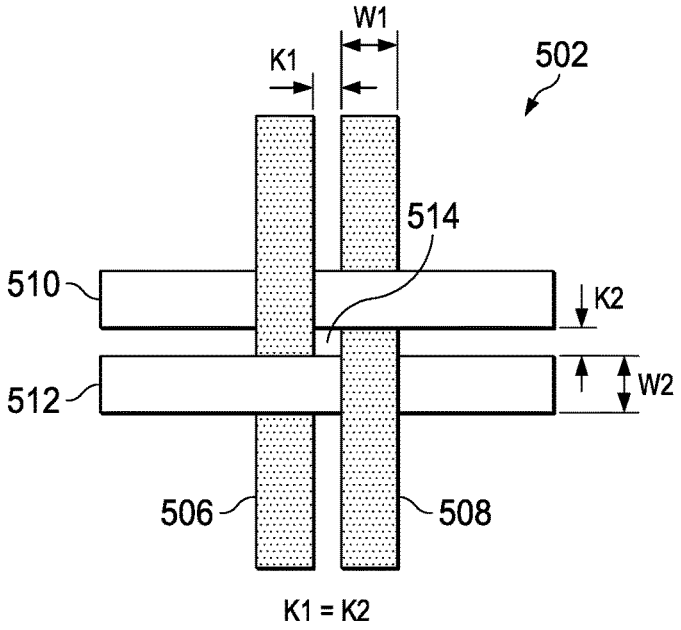
Figure 5E:
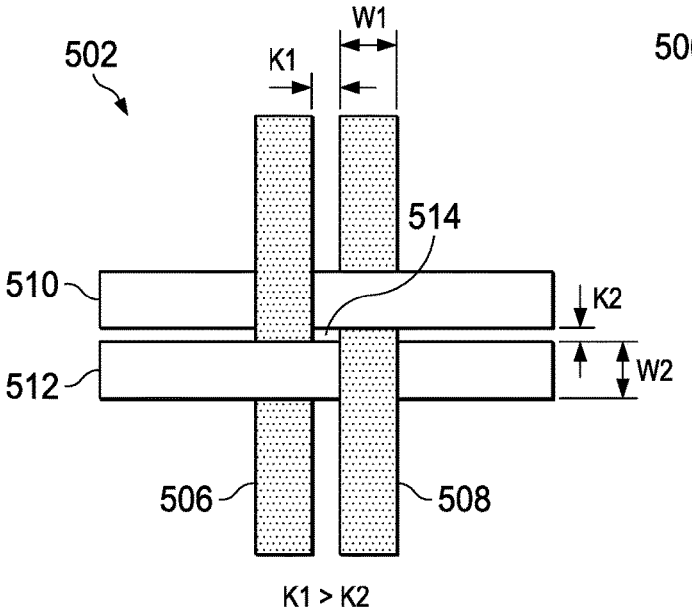
Figure 5F:
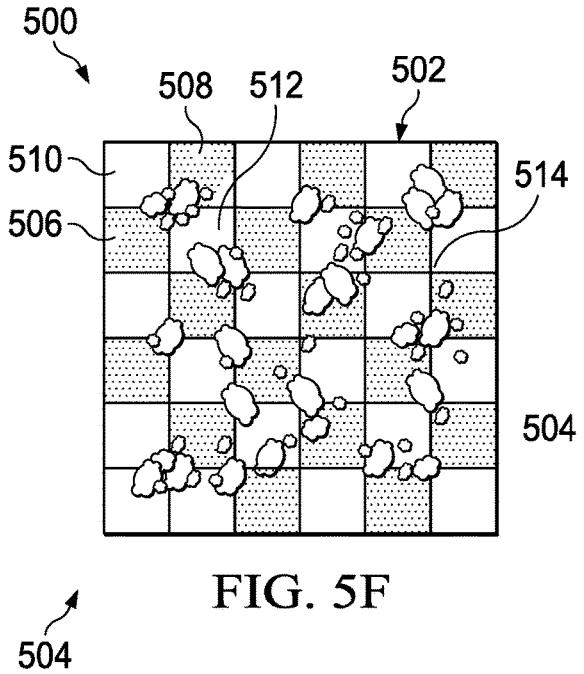

FIG. 4 shows a lost circulation system 400 configured to reduce losses of drilling fluid in a lost circulation zone of a wellbore. The lost circulation system 400 includes a sheet of a lost circulation fabric 402 with holes 416 extending through the sheet of lost circulation fabric 402 and particles of a second lost circulation material 404. The sheet of the lost circulation fabric is a material whose structure and composition limit the flow of fluids, particularly drilling fluid, through the sheet. The sheet of a lost circulation fabric 402 dimensional properties of thickness 406, length 408, and width 410 are substantially similar to the sheet of a first lost circulation material 202 described earlier with reference to FIG. 2. The sheet of a lost circulation fabric 402 physical properties of an elastic modulus, a tensile strength, a surface roughness, a toughness, and a thermal stability that are substantially similar to the sheet of a first lost circulation material 202 described earlier with reference to FIG. 2.

The sheet of a lost circulation fabric 402 includes a polymeric membrane. A membrane is a thin layer of material that is a selective barrier which stops some things (for example, particles or ions), but allows other larger things to pass through. A polymeric material, such as a polymer or a fiber-reinforced polymer is flexible, yet tough and abrasion resistant. For example, the sheet of the lost circulation material 402 can be made of polypropylene or polyethylene. The sheet of the lost circulation material 402 be porous, however the sizing of the pores in the fabric can be such that the second lost circulation material 404, otherwise lost through a large pore size lost circulation zone, accumulate on the sheet of a lost circulation fabric 402.

The sheet of a lost circulation fabric 402 includes multiple openings 416. Each adjacent pair of multiple openings 416 has a major dimension K between 0.005 millimeters and 5 millimeters. The multiple openings 416 with a spacing S between adjacent pairs of multiple openings. Spacing S is determined by a relationship between the major dimension and the spacing S, where K=n*S. N is a unitless coefficient between 0 and 2. The sizing of the major dimension K of the openings 416 in the fabric can be such that the second lost circulation material 404, otherwise lost through large openings into the lost circulation zone, accumulate on the sheet of a lost circulation fabric 402. The opening 416 can be a geometric shape or irregular. For example, opening 416 can be a circle, a square, a pentagon, or bean shaped. The sheet of a lost circulation fabric 402 has multiple shapes of openings 416. The major dimension K is the largest dimension of the opening. For example, the major dimension K of a circle is the diameter. The major dimension K of a square is the diagonal. The spacing S between adjacent openings is the closest distance between openings 416. Openings 416 can be spaced irregularly or in a pattern on the sheet of a lost circulation fabric 402. The multiple openings 416 can contain different geometric shapes.

The sheet of a lost circulation fabric 402 can be a fabric woven from threads of a first material and a second material. A fabric woven from threads of a first material and a second material is can also be known as a composite. The composite can include polypropylene resin mixed with plasticizers, stabilizers, and/or fillers. In some implementations, the first material is a polymer and the second material is a polymer. The polymer can be substantially similar to the polymer described earlier with reference to FIG. 2. In some implementations, the first material is a polymer and the second material is non-polymeric. For example, a non-polymer can be a carbon fiber or a metal fiber. For example, a metal fiber can be aluminum or steel. Threads of the fiber can be of the same thickness or differing thicknesses.

FIGS. 5A through 5F show a lost circulation system 500 configured to reduce losses of drilling fluid in a lost circulation zone of a wellbore. The lost circulation system 500 includes woven strip lost circulation fabric 502 and particles of a lost circulation material 504. The woven strip lost circulation fabric 502 includes a first strip of fabric material 506, a second strip of fabric material 508 proximal and parallel to the first strip of fabric material 506, a third strip of fabric material 510 interwoven between second strip of fabric material 508 and the first strip of fabric material 506, and a fourth strip of fabric material 512 interwoven between the first strip of fabric material 506 and the second strip of fabric material 508, parallel to the third strip of fabric material 510, and interwoven opposite the third strip of fabric material 510.

Each strip of fabric material is spaced from another strip of fabric material by a spacing K. The first strip of fabric material 506 is spaced from the second strip of fabric material 508 by a first spacing $K_1$. The third strip of fabric material 510 is spaced from the fourth strip of fabric material 512 by a spacing $K_2$. $K_1$ and $K_2$ can be the same or differ. For example, $K_1$ and $K_2$ can be equal, $K_1$ can be greater than $K_2$, or $K_1$ can be less than $K_2$. $K_1$ and $K_2$ can be between 0.005 mm and 5 mm.

Each strip of fabric material has a width W. The first strip of fabric material 506 has a width $W_1$. The second strip of fabric material 508 has a width $W_2$. The third strip of fabric material 510 has a width $W_3$. The fourth strip of fabric material 512 has a width $W_4$. $W_1$, $W_2$, $W_3$, and $W_4$ can be the same or differ. $W_1$, $W_2$, $W_3$, and $W_4$ are determined by a relationship between the major dimension K and the width W, where $K_1=n*W_1$. N is a unitless coefficient between 0 and 2.

The combination of the first strip of fabric material 506 with width $W_1$, the second strip of fabric material 508 with width $W_2$, the third strip of fabric material 510 with width $W_3$, the fourth strip of fabric material 512 with width $W_4$, interwoven at the spacing $K_1$ and $K_2$ define multiple openings 514 in the woven strip lost circulation fabric 502 at the intersection.

Referring to FIGS. 5A-5E, the width W of strip of fabric material and the spacing between two strips of fabric material K define an opening ratio N. N equals K/W. For example, N can equal 0, 0.3, or 0.5.

The lost circulation material 504 is substantially similar to the second lost circulation material 202 and the sheet of a lost circulation fabric 402 described earlier with reference to FIG. 2 and FIG. 4.

Figure 6A:
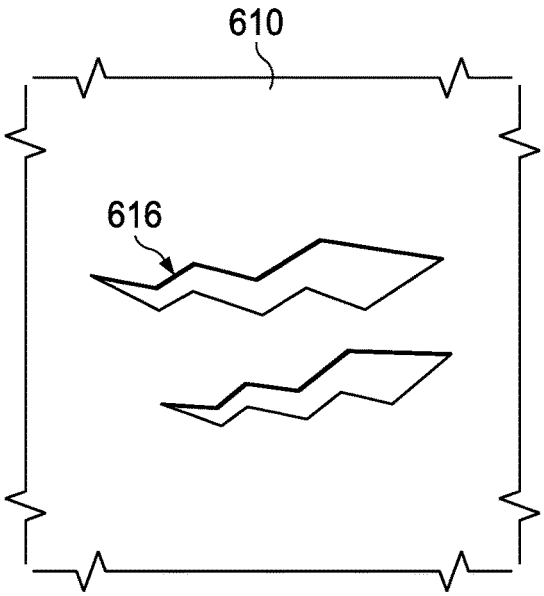
FIGS. 6A-6E are schematics of a woven strip lost circulation fabric and a slurry placed over a lost circulation zone.
Figure 6B:
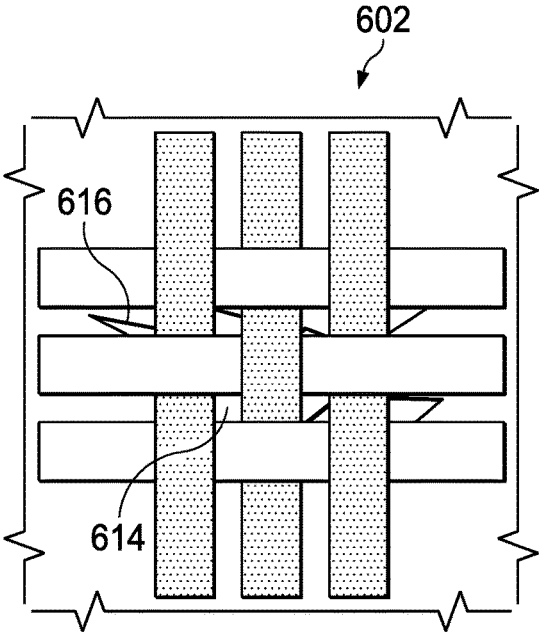
Figure 6C:
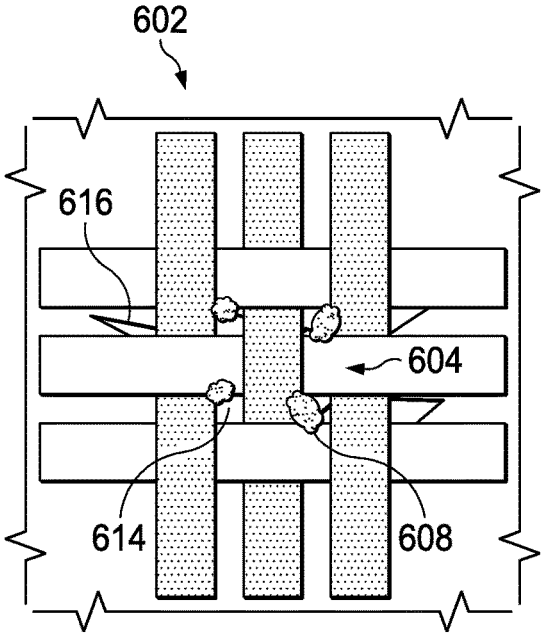
Figure 6D:
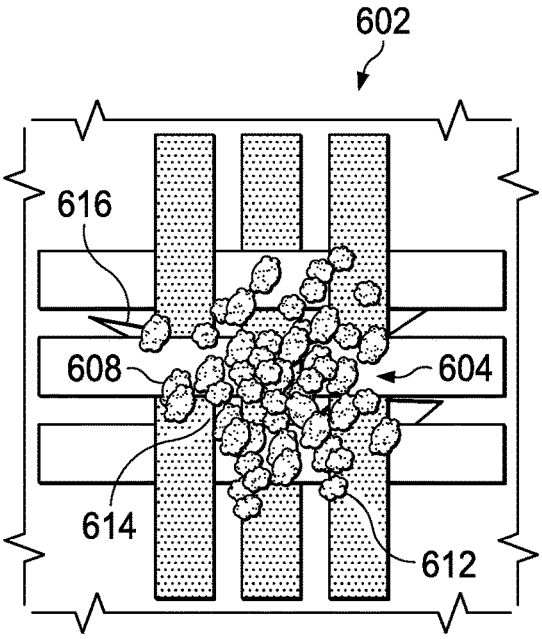
Figure 6E:
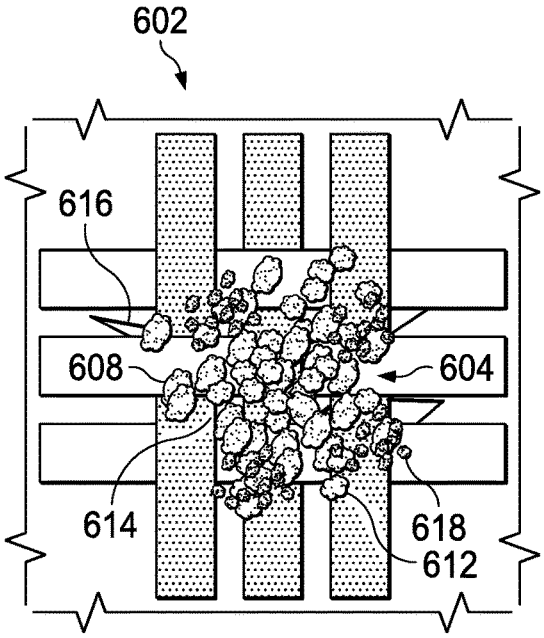

FIGS. 6A-6E are schematics illustrating a method of placing a woven strip lost circulation fabric and a lost circulation material slurry over a lost circulation zone. FIG. 6A shows a front view of a loss circulation zone 616 on the surface of a wellbore 610. FIG. 6B shows a woven strip lost circulation fabric 602 placed over the lost circulation zone 616. The multiple openings 614 still allow some lost circulation fluid flow. FIG. 6C shows large particles 602 of the lost circulation slurry 604 accumulating over the multiple openings 614. The larger particles 608 in the lost circulation slurry 604 further reduce lost circulation fluid flow. The gaps between large particles are smaller than the openings 614 so smaller particles begin to accumulate. FIG. 6D shows more large particles 608 and some medium particles 612 of the lost circulation slurry 604 accumulating over the multiple openings 614. FIG. 6E shows more large particles 608, more medium particles 612, and small particles 618 of the lost circulation slurry 604 accumulating over the multiple openings 614 further reducing lost circulation fluid flow to less than shown in FIG. 6D. The woven strip lost circulation fabric 602, large particles 608, medium particles 612, and small particles 618 of the lost circulation slurry 604 combine over the woven strip lost circulation fabric 602 to for a filter cake over the lost circulation zone 616.

Figure 7:
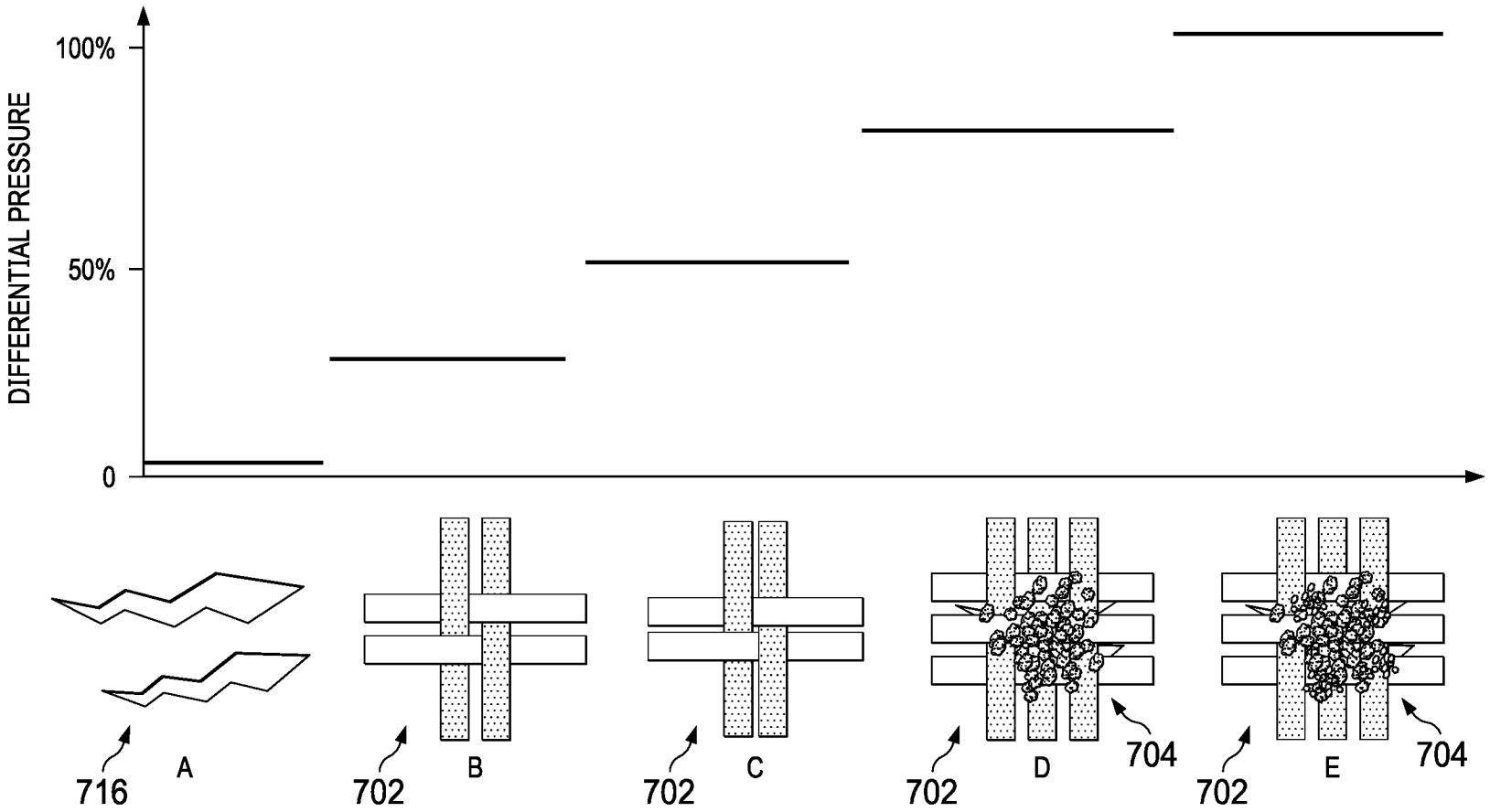
FIG. 7 is a graph of the differential pressure across various lost circulation fabrics and slurry variations.

FIG. 7 is a graph of the differential pressure across various lost circulation fabrics and slurry variations. The woven strip lost circulation fabric 702 and lost circulation slurry 704 are substantially identical to the woven strip lost circulation fabric and lost circulation slurry described earlier with reference to FIGS. 5 and 6. Differential pressure across the wellbore surface of the lost circulation zone can be measured as a percentage. The differential pressure percentage can be calculated by using the wellbore fluid pressure as the maximum and the formation pressure as the minimum. For example, the maximum differential pressure across the wellbore surface of the lost circulation zone would occur when the opening is completely sealed allowing no fluid flow. For example, the minimum differential pressure across the wellbore surface of the lost circulation zone would occur when no LCF or LCM are present, allowing fluid to flow freely. For example, at stage "A", the lost circulation zone 716 is open and allowing fluid. The differential pressure across the wellbore surface is zero. At "B", the woven strip lost circulation fabric 702 is placed over the lost circulation zone 716. The multiple openings 614 still allow some lost circulation fluid flow. The differential pressure across the wellbore surface is 25%. At "C", the woven strip lost circulation fabric 702 is placed over the lost circulation zone 716 has a smaller opening ratio N than the opening ratio N of "B". The multiple openings 714 allow less flow lost circulation fluid flow than "B". The differential pressure across the wellbore surface is higher than "B" at 50%. At "D", the woven strip lost circulation fabric 702 is placed over the lost circulation zone 716. Large particles 708 and medium particles 712 of the lost circulation slurry 704 accumulating over the multiple openings 714 further reduce lost circulation fluid flow to less than shown in "C". The multiple openings 714 still allow some lost circulation fluid flow. The differential pressure across the wellbore surface is 75%. At "E", the woven strip lost circulation fabric 702 is placed over the lost circulation zone 716. Large particles 708, medium particles 712, and small particles 718 of the lost circulation slurry 704 accumulating over the multiple openings 714 further reduce lost circulation fluid flow to less than shown in "D". The multiple openings 714 allows little to no lost circulation fluid flow. The differential pressure across the wellbore surface is 100%.

A lost circulation system configured to reduce losses of drilling fluid in a lost circulation zone of a wellbore, the system comprising a sheet of a first lost circulation material suitable for deployment in a wellbore; and particles of a second lost circulation material with mixed sizes and lengths. For example, the particles of the second lost circulation material can contain marble particles. The marble particles can have a characteristic size between one millimeter and five millimeters. For example, the particles of the second lost circulation material can contain calcium carbonate flakes. The calcium carbonate flakes can have a characteristic size between one millimeter and five millimeters. For example, the particles of the second lost circulation material can contain date palm tree fibers. The date palm tree fibers have a characteristic size between one millimeter and five millimeters. For example, the particles of the second lost circulation material can contain date seed particles. The date seed particles can have a characteristic size between one millimeter and five millimeters.

Figure 8:
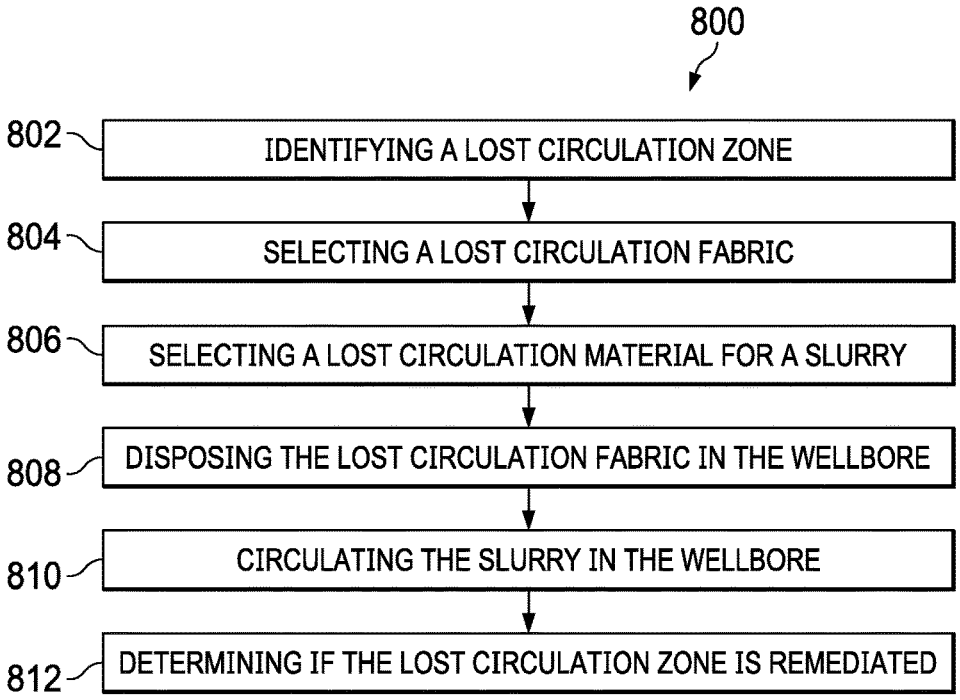
FIG. 8 is a flow chart of an example method of remediating a lost circulation zone.

FIG. 8 is a flow chart of an example method of remediating a lost circulation zone. A wellbore loss zone is remediated to reduce losses of drilling fluid in the lost circulation zone of the wellbore. At 802, a lost circulation zone is identified in a wellbore. At 804, a lost circulation fabric is selected. At 806, a lost circulation material is selected for a slurry. At 808, the lost circulation fabric is disposed in the wellbore. At 810, the slurry is circulated in the wellbore. At 812, it is determined if the lost circulation zone is remediated.

Identifying the lost circulation zone can include determining a loss flow percentage, determining a loss flow target percentage, and identifying portions of a subterranean formation where the loss flow percentage exceeds the loss flow target percentage. The loss flow percentage can be determined, for example, by measure the fluid flow return to the surface of the earth at the drilling rig. The loss flow target percentage can be determined by previous experience, historical data, acceptable cost, or safety concerns. Portions of a subterranean formation where the loss flow percentage exceeds the loss flow target percentage can be identified by geological boundaries or pressure sensors. Determining if the lost circulation zone is remediated includes determining if the loss flow percentage is equal or less than the loss flow target percentage after disposing the lost circulation fabric in the wellbore and circulating the slurry in the wellbore.

Lost circulation zones can be categorized as a minor loss zone if the lost flow percentage is less than twenty-five percent, as an intermediate loss zone if the lost flow percentage is between twenty-five percent and seventy-five percent, and as a severe loss zone if the lost flow percentage is greater than seventy-five percent.

Selecting the lost circulation fabric for an intermediate loss zone can include selecting a lost circulation fabric with multiple characteristic openings between one millimeter and three millimeters in size. The multiple characteristic openings are a multiple holes with a hole spacing between the holes. The slurry for an intermediate loss zone includes a sufficient quantity of particles sized greater than the major dimension K of one to three millimeters to accumulate on the sheet of a lost circulation fabric. The slurry for the intermediate loss zone includes particles sized smaller than the major dimension K of one to three millimeters to accumulate on the sheet and the larger particles. The mechanism of curing loss by this particular slurry is based on the physical properties of the materials in the slurry not by chemical reaction. Therefore, material size, dimension and strength are the most important characteristics. Less coarse materials are used as compared to medium and fine grades for intermediate loss zone.

Selecting the lost circulation fabric for a severe loss zone can include selecting a lost circulation fabric with multiple characteristic openings greater than three millimeters and less than five millimeters in size. The multiple characteristic openings are a multiple holes with a hole spacing between the holes. The slurry for a severe loss circulation zone includes a sufficient quantity of particles sized greater than the major dimension K of three to five millimeters to accumulate on the sheet of a lost circulation fabric. The slurry for the severe loss zone includes particles sized smaller than the major dimension K of three to five millimeters to accumulate on the sheet and the larger particles.

Selecting the lost circulation material for the slurry can include selecting a first lost circulation material with a characteristic size that is larger than a characteristic size of the lost circulation fabric for a first slurry and a second lost circulation material for a second slurry with a characteristic size that is smaller than a characteristic size of the lost circulation fabric. Selecting the lost circulation material can include selecting the first lost circulation material characteristic size to be greater than three millimeters and less than or equal to five millimeters for a first slurry and the second lost circulation material for a second slurry characteristic size is between one millimeter and three millimeters in size. Selecting a lost circulation material can include selecting a first lost circulation material with some particles with a characteristic size that is larger than a characteristic size of the lost circulation fabric and with some particles of the second lost circulation material with the characteristic size that is smaller than the characteristic size of the lost circulation fabric. Some of the particles of the first lost circulation material can have a characteristic size larger than three millimeters and less than or equal to five millimeters and some of the particles of the second lost circulation material can have a characteristic size between one millimeter and three millimeters in size.

Remediating a wellbore loss zone can include identifying a lithology of the subterranean formation in the lost circulation zone. Formation characteristics such as porosity, pore size, pressure, fracture gradient, and permeability, can be determined and analyzed to better determine the lost circulation fabric and lost circulation material slurry best suited to remediate the section of wellbore having an intermediate or severe lost circulation.

Figure 9:
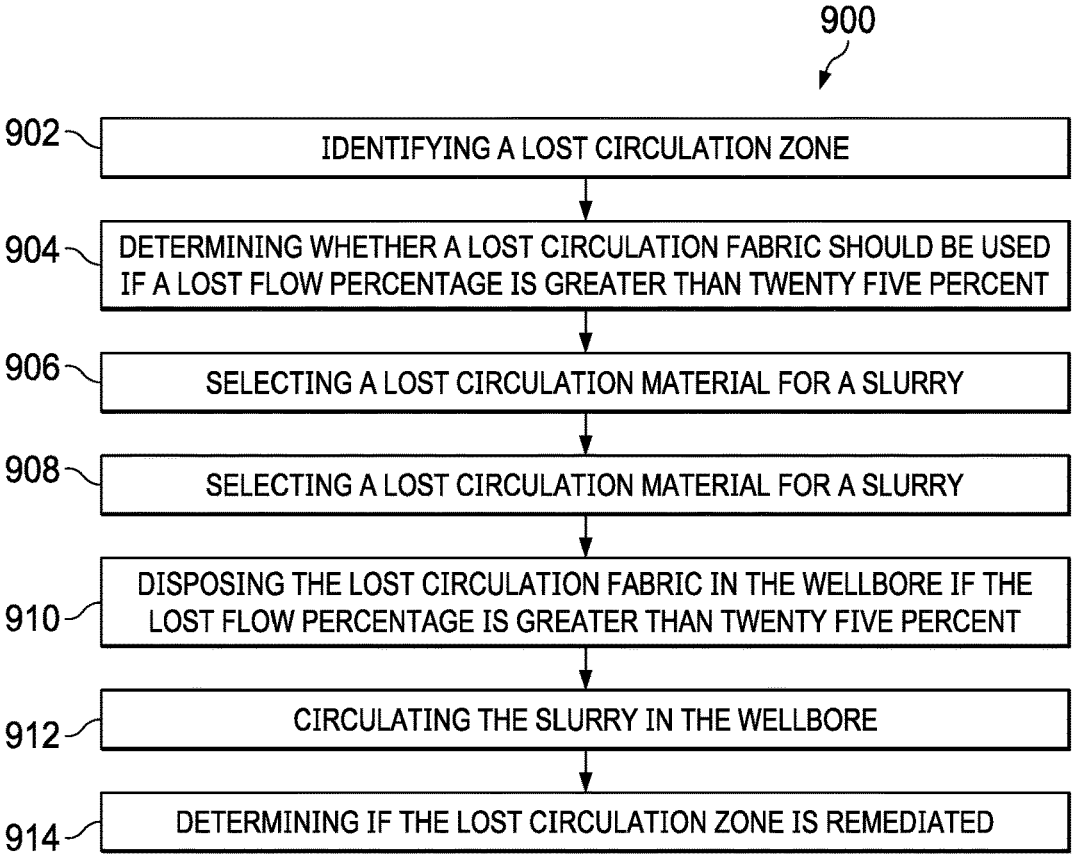
FIG. 9 is a flow chart of an example method of remediating a lost circulation zone.

FIG. 9 shows a wellbore loss zone remediation method 900 to reduce losses of drilling fluid in a lost circulation zone of a wellbore. At 902, a lost circulation zone is identified in a wellbore. At 904, if a lost flow percentage is greater than twenty five percent, it is determined whether a lost circulation fabric should be used. If it is determined that the lost circulation fabric should be used and the loss flow percentage is between twenty five percent and seventy five percent, then the lost circulation fabric selected has characteristic openings between one millimeter and three millimeters in size. Characteristic openings are multiple holes with a hole spacing between the holes. If it is determined that the lost circulation fabric should be used for a lost flow percentage greater than seventy five percent, then the lost circulation fabric selected has characteristic openings greater than three millimeters and less than five millimeters in size. At 906, a lost circulation material is selected for a slurry. If the lost flow percentage is between twenty five percent and seventy five percent, the lost circulation material selected for the slurry includes particles sized greater than one to three millimeters to accumulate on the sheet of the lost circulation fabric and particles sized smaller than one to three millimeters to accumulate on the sheet of the lost circulation fabric and the particles sized greater than one to three millimeters. If the lost flow percentage is greater than seventy five percent, the lost circulation material selected for the slurry includes particles sized greater than three to five millimeters to accumulate on the sheet of a lost circulation fabric and particles sized smaller than three to five millimeters to accumulate on the sheet and the particles greater than three to five millimeters. At 908, the selected lost circulation fabric is disposed in the wellbore if the lost flow percentage is greater than twenty five percent. At 910, the slurry is circulated in the wellbore. At 912, it is determined if the lost circulation zone is remediated.

FIG. 10 shows an LCF deployment tool 1000. The LCF deployment tool 1000 can place a large area of LCF 1002 to seal a long section of lost circulation zone 1004, for example, by compacting the LCF 1002 within the LCF deployment tool 1000 to bring the LCF 1002 downhole. LCF deployment tool 1000 can also allow for multiple LCF 1002 strips to be applied to a wellbore wall in a single deployment process. When multiple LCF strips are applied to a wellbore wall, the LCF strips can overlap. For example, the LCF deployment tool 1000 can apply multiple LCF strips around an entire circumference of a wellbore wall in a selected section of the wellbore 1006.

The LCF deployment tool 1000 was generally described earlier with reference to FIG. 1. The LCF deployment tool 1000 and associated methods of use are described in detail in U.S. patent application Ser. No. 16/831,426, filed on Mar. 26, 2020, which is incorporated herein by reference in its entirety.

The LCF 1002 can be substantially similar to the sheet of a first lost circulation material 202 described earlier with reference to FIG. 2, the sheet of a lost circulation fabric 402 with holes 416 described earlier with reference to FIG. 4, or woven strip lost circulation fabric 502 described earlier with reference to FIGS. 5A-5F.

The LCF deployment tool 1000 can be provided along the BHA 1008 or around a section of drill pipe 1010 proximate to the BHA 1008. LCF 1002 can be compacted, e.g., folded or rolled, and stored in the LCF deployment tool 1000 until the LCF 1002 is released to cover a selected section 1012 of the wellbore 1006.

A selected section 1012 of a wellbore 1006 to be covered by LCF 1002 can include, for example, a highly fractured or porous section of the wellbore 1006. Fractured portions of the wellbore 1006 can be naturally occurring or induced (e.g., from drilling operations).

Figure 11:
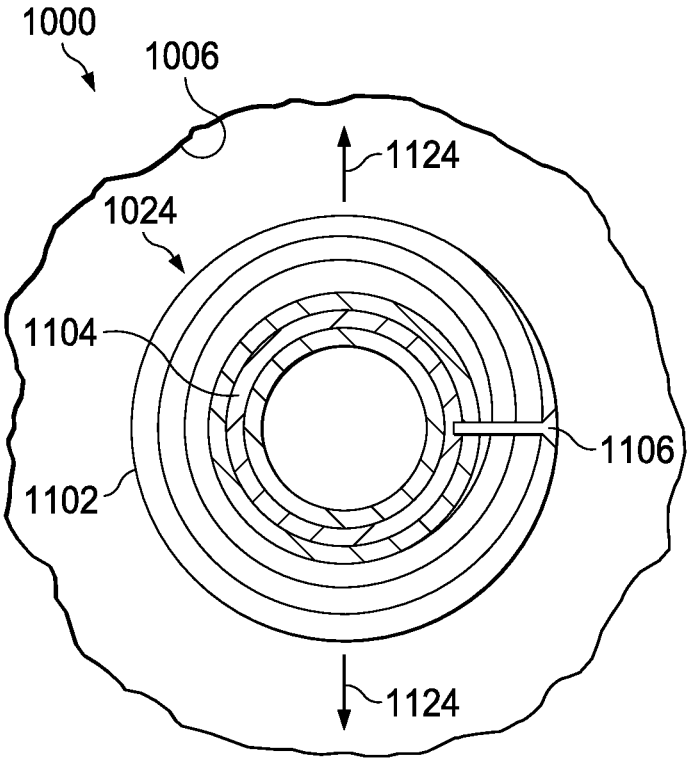
FIGS. 11-14 show cross-sectional views of the LCF deployment tool in FIG. 10.
Figure 12:
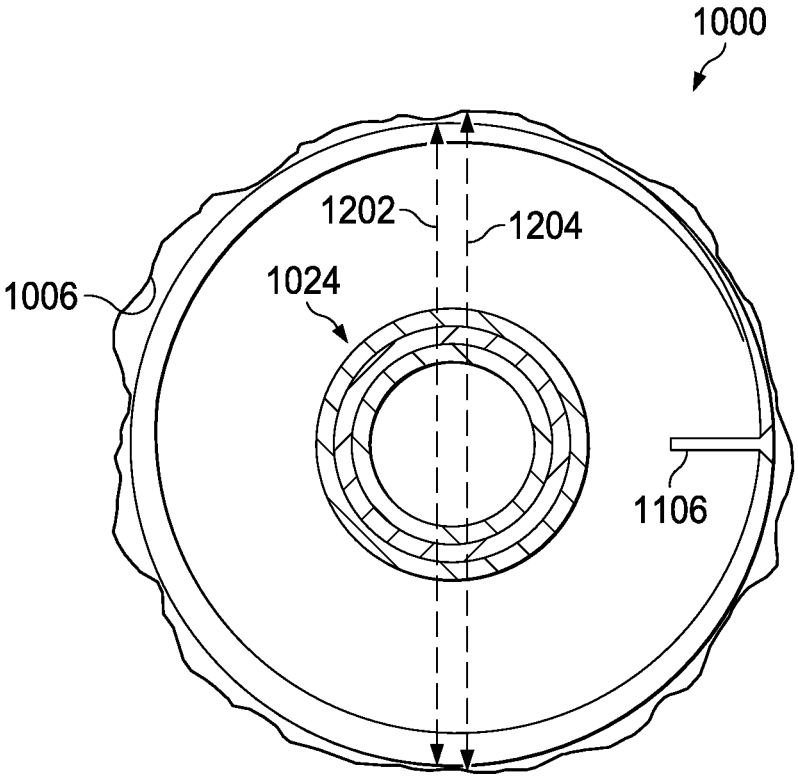

FIGS. 11 and 12 are cross-sectional views of a retention mechanism 1016 along a radial plane A-A of FIG. 10 transversing the longitudinal axis 1022. As shown in FIG. 11, the retention mechanism 1016 includes a spiral spring 1102 that can be locked to a lock tube 1104 by a lock pin 1106 mounted around the periphery of the spiral spring 212. The spiral spring 1102 can be made of, for example, a rolled-up metal sheet. The lock pin 1106 holds the spiral spring 1102 locked in its compressed narrowed position as the LCF deployment tool 1000 is sent downhole to a position beneath a selected loss zone section of a wellbore 1006. When the LCF deployment tool 1000 is in position, the spiral spring 1102 can be unlocked, e.g., using a signal transmitted downhole to the LCF deployment tool 1000 or a drop ball to release the lock pin 1106 from the lock tube 1104, to allow the spiral spring 1102 to expand in the radial direction.

Once the retention mechanism 1016 is unlocked, the spiral spring 1102 radially expand to its expanded position shown in FIG. 12. The spiral spring 1102 can be designed to expand to an outer diameter 1202 that is greater than or equal to an inner diameter 1204 of the wellbore 1006 into which the LCF deployment tool 1000 is to be deployed. Because a wellbore 1006 wall can have an uneven surface, the spiral spring 1102 can be stopped by ridges or protrusions along the wellbore 1006 wall from fully expanding to its designed fully expanded outer diameter 1202. By such design, when the spiral spring 1102 is unlocked and radially expanded to the expanded position, the spiral spring 1102 can radially expand to contact the wellbore 1006 wall and be held by the spring force of the spiral spring 1102.

The first end 1014 of the LCF 1002 is attached to the spiral spring 1102. After the spiral spring 1102 is set along the wellbore 1006 wall, the spiral spring 1102 holds the LCF 1102 in place after deployment.

The LCF deployment tool 1000 also includes a spool assembly 1024 having at least one spool 1026 mounted to a spool ring 1302.

Figure 13:
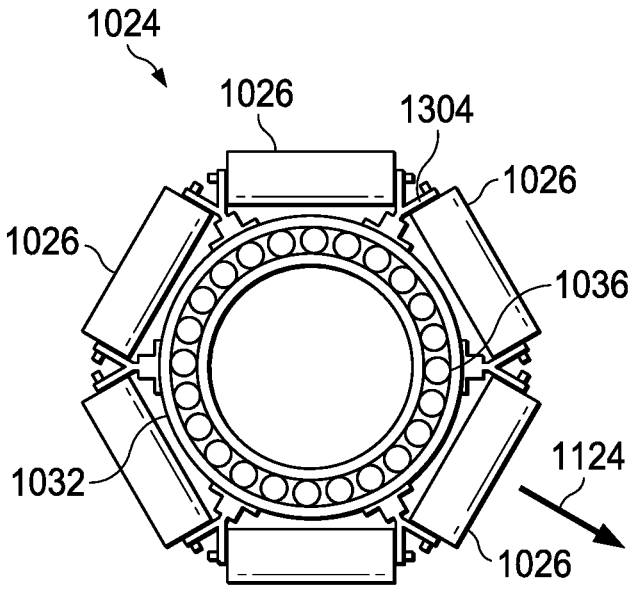

FIG. 13 is a cross-sectional view of the spool assembly 1024 along a radial plane B-B transverse to the longitudinal axis of FIG. 10 showing six spools 1026 and spool ring 1302. The spools 1026 are mounted on mounting brackets 1304 around the spool ring 1302 in an orientation where the spool's rotational axis is perpendicular to the radial direction 1124 and lying on a plane transverse to the longitudinal axis 1022 of the LCF deployment tool 1000. The spool ring 1302 can include ball bearings 1306 to allow for rotational and/or axial movement of the spool assembly 1024 along the LCF deployment tool 1000. The spool rings 1302 are arranged such that LCF 1002 is deployable across the entire circumference of the wellbore 1106. As seen in FIG. 10, the spool assembly 1024 includes two sets of spools 1026 arranged such that the edges of the strips of LCF 1002 overlap when deployed such that no gaps are provided that could result in continued lost circulation.

The LCF deployment tool 1000 can further include a compacted LCF 1002 stored around the spool 1026 and retained by the retention mechanism 1016. Multiple strips of LCF 1002 can be stored in a compacted configuration as the LCF deployment tool 1000 is sent downhole. A first end 1014 of the LCF 1002 can be attached to the retention mechanism 1016, and a second end 224 of the LCF 1002 can be wound around the spool 1026.

By winding the second end 224 of the LCF 1002 around the spool 1026, the LCF 1002 can be partially released from the LCF deployment tool 220 by radially expanding the retention mechanism 1016, as described above, to create a radial spacing between the first end 1014 of the LCF 1002 retained by the radially expanded retention mechanism (specifically, spiral spring 212) and the LCF deployment tool 1000 (specifically, spool 1026).

The LCF deployment tool 1000 can further include at least one roller arm 1020, which can be radially 1124 expanded from the LCF deployment tool 1000 after complete release of the LCF 1002 and rolled over the LCF 1002 along the selected section 1012 of the wellbore 1006 to assure the LCF 1002 is flattened along the wellbore wall.

The LCF deployment tool 1000 also includes an underreamer 1040 axially spaced from the retention mechanism 1016. The underreamer 1040 is expandable in the radial direction from the longitudinal axis toward a surrounding wellbore 1006. One or more underreamers 1040 can be provided around a single tubular body 1028 of the LCF deployment tool 1000. The LCF deployment tool 1000 has three underreamers 1040. The underreamer 1040 can be provided around a separate tubular body from the LCF deployment tool 1000 having one or more retention mechanism(s) and compacted LCF. The LCF deployment tool 1000 can be provided as part of a BHA, where the underreamer 1040 are positioned axially closer to the drill bit than the retention mechanism 1016 and compacted LCF 1002.

The underreamers 240 include multiple cutting elements 1030 disposed on an outer surface of an underreamer arm 1032. When the underreamer 240 radially expands, the cutting elements 1030 can contact and cut the surrounding wellbore wall as the underreamer 240 rotates about the longitudinal axis 1022 (e.g., from rotation of a drill string and attached BHA having the LCF deployment tool 1000 during a drilling operation).

The LCF deployment tool 1000 can include both underreamers 1040 and roller arms 1020 disposed around a tubular body 1028 and axially spaced from the retention mechanism 1016 and compacted LCF 1002. For example, as shown in FIG. 10, underreamer 1040 and at least one roller arm 1020 can be mounted to a positions axially apart from the retention mechanism 1016. For example, the mounting collar 1032 can be axially closer to a drill bit on a drill string than the retention mechanism 1016.

Figure 14:
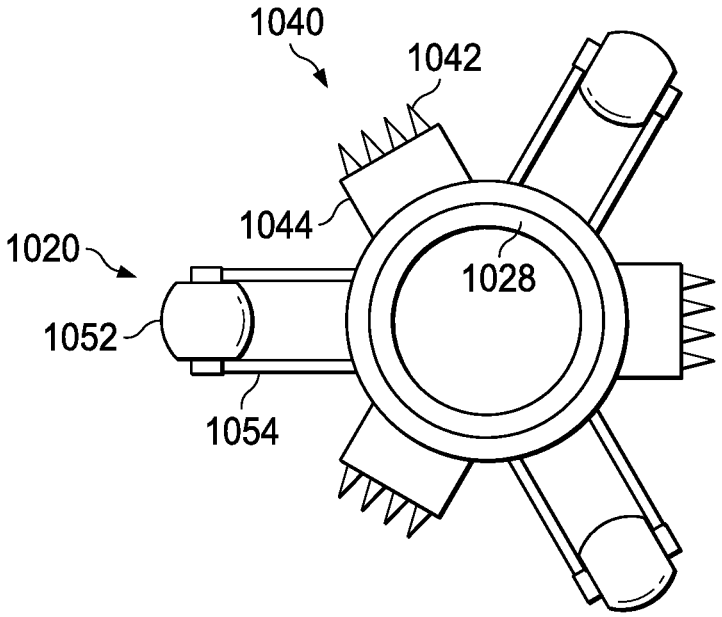

FIG. 14 is a cross-sectional view of the LCF deployment tool 1000 along a radial plane C-C transverse to the longitudinal axis 1022 which shows the circumferential positions of the underreamers 1040 and roller arms 1020 around the tubular body 1028. The underreamers 1040 and roller arms 1020 can be equally spaced around the tubular body 1028 in an alternating fashion.

The underreamers 1040 have a first end 1042 mounted to the mounting collar 1032, while a second end 1044 of the underreamers 1040 are mounted to a first sliding collar 1034. The underreamers 1040 have at least one pivot point 1046 between the arms 1048 of the underreamer 1040, which allows the arms 1048 to pivot radially outwardly as the first end 1042 and second end 1044 of the underreamers 1040 are moved closer together. In such manner, the first sliding collar 1034 (and attached second end 1044 of the underreamer 1040) can axially move closer to the mounting collar 1032 to radially expand the underreamers 1040.

Similarly, the roller arm 1020 has a first end 1056 mounted to the mounting collar 1032, while a second end 1058 is mounted to a second sliding collar 1064. The rollers 1052 of the roller arms 1020 are mounted at a pivot point between the arms 1054 of the roller arms 1020, such that, as the first and second ends 1056, 1058 of the arms 1054 are moved toward each other, the rollers 1052 move radially outward (in radial direction 1124). In such manner, the second sliding collar 1064 (and attached second end 1058 of the roller arms 1020) axially move closer to the mounting collar 1032 to radially expand the rollers 1052. The second sliding collar 1064 can include a set of springs 1066 (or other movement compensation system) that can allow relatively smaller radial movements inward and outward from the LCF deployment tool 1000 as the rollers 1052 roll along an uneven wellbore 1006.

The first sliding collar 1062 and second sliding collar 1064 can move axially independently of each other. For example, the first sliding collar 1062 can move toward the mounting collar 1032 to radially expand the underreamers 1040, while the second sliding collar 1064 can be positioned axially distal from the mounting collar 1032 to hold the roller arms 1020 in a radially contracted position. Conversely, the second sliding collar 1064 can move toward the mounting collar 1032 to radially expand the roller arms 1020, while the first sliding collar 1062 can be positioned axially distal from the mounting collar 1032 to hold the underreamers 1040 in a radially contracted position.

The first sliding collar 1062 and second sliding collar 1064 can be axially movable along the tubular body 1028, for example, using one or more of motorized components, hydraulic components, springs, bearings, and locking mechanisms. Further, the first sliding collar 1062 and second sliding collar 1064 can utilize the same moving mechanisms or different moving mechanisms to axially move along the tubular body 1028.

The retention mechanism 1016 of the LCF deployment tool 1000 includes a spiral spring 1102 locked to a lock tube 1104. However, other types of radially expandable retention mechanisms can be used to retain at least a portion of an LCF 1002, e.g., one or more radially expandable arms. By using a retention mechanism that radially expands from the LCF deployment tool body toward a surrounding wellbore wall while retaining an end of the LCF 1002, a released portion of the LCF 1002 (e.g., LCF released from one or more spool 1026, described below) can be flowed over a selected loss zone section of the wellbore by circulating drilling fluid between the radially expanded end of the LCF and the LCF deployment tool body.

FIGS. 15-22 show an example method for applying an LCF 1002 to a lost circulation zone 1012 of a wellbore 1006 using the LCF deployment tool 1000 shown in FIGS. 10-14.

Figure 15:
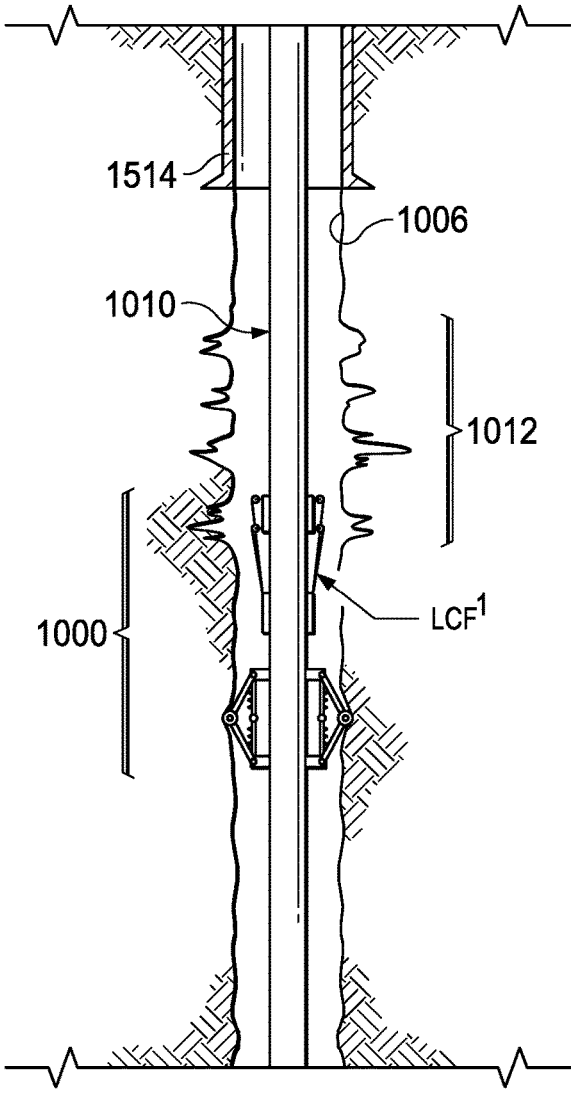
FIGS. 15-18 show stages of a method of the LCF deployment tool in FIG. 10.

As shown in FIG. 15, the LCF deployment tool 1000 can be assembled to a tubular body 202, such as a drill string, and sent downhole. For example, the LCF deployment tool 1000 can be assembled to a BHA and sent downhole during a drilling operation, drilling a wellbore 1006. Sections of the wellbore 1006 can be cased with casing 1514 as the drilling progresses. A loss zone can be determined along the open hole (uncased) portion of the wellbore 1006 and selected as a lost circulation zone 1012 to be covered with LCF 1002. The LCF deployment tool 1000 can be positioned below (farther away from the surface of the well) or partially below the lost circulation zone 1012.

Figure 16:
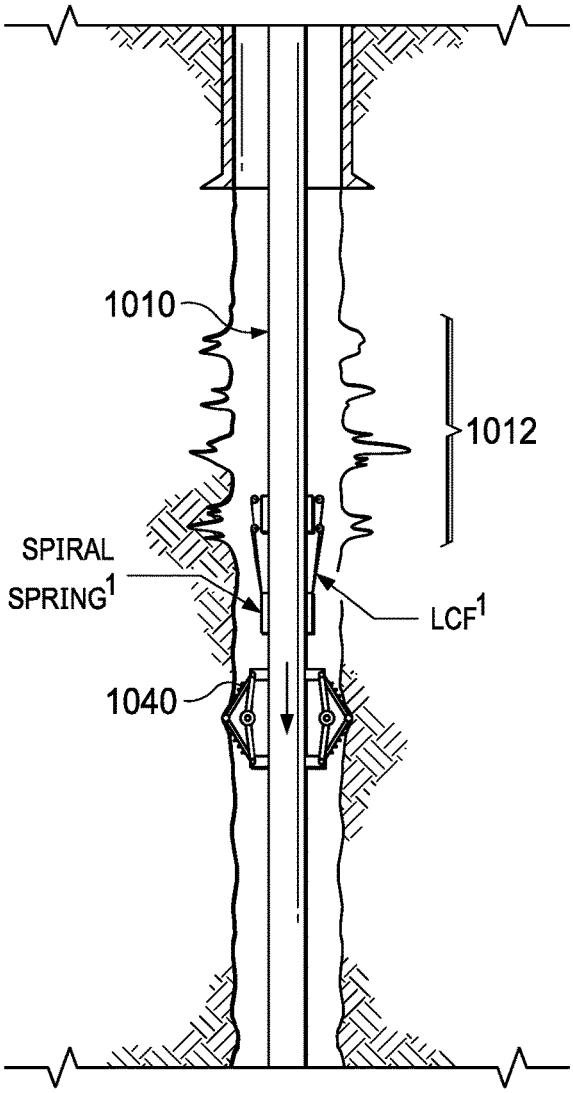

As shown in FIG. 16, a signal can be sent to radially expand the underreamers 1040 from the LCF deployment tool 1000 to contact the wellbore 1006 wall. The underreamers 1040 can be electrically released, for example by sending a wired or wireless signal to communicate with the underreamers 1040, or the underreamers 1040 can be mechanically released to expand radially outward, for example, by dropping a ball through the tubular body 1010 to activate the underreamer 1040 expansion.

Figure 17:
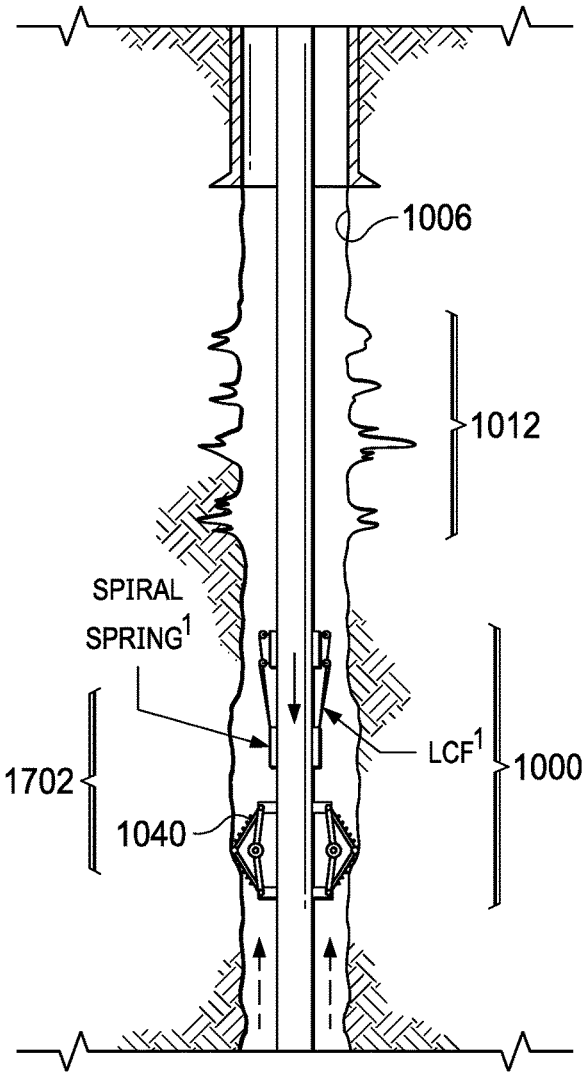

As shown in FIG. 17, the LCF deployment tool 1000 can be rotated as the underreamers 1040 are radially expanded to contact the wellbore 1006 wall (where the LCF deployment tool 1000 rotation can be from the drill string rotation for drilling the wellbore 1006), such that an under reamed section 1702 of the wellbore 1006 downhole of the lost circulation zone 1012 of a wellbore is under reamed to a larger inner diameter.

Figure 18:
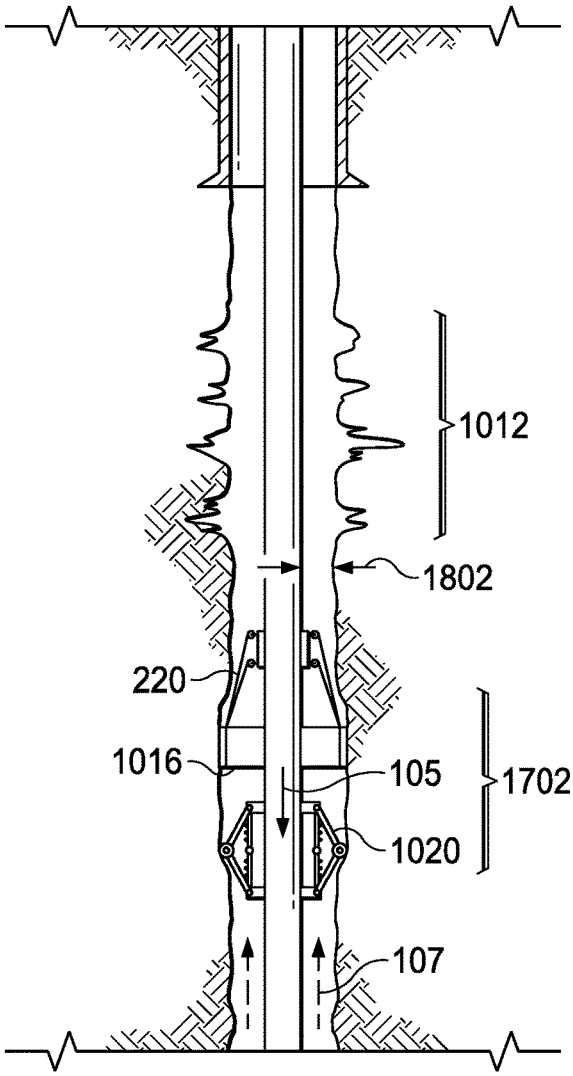

As shown in FIG. 18, a command can be sent to radially expand the retention mechanism 1016 of the LCF deployment tool 1000 to contact the under reamed section 1702 of the wellbore 1006.

Figure 19:
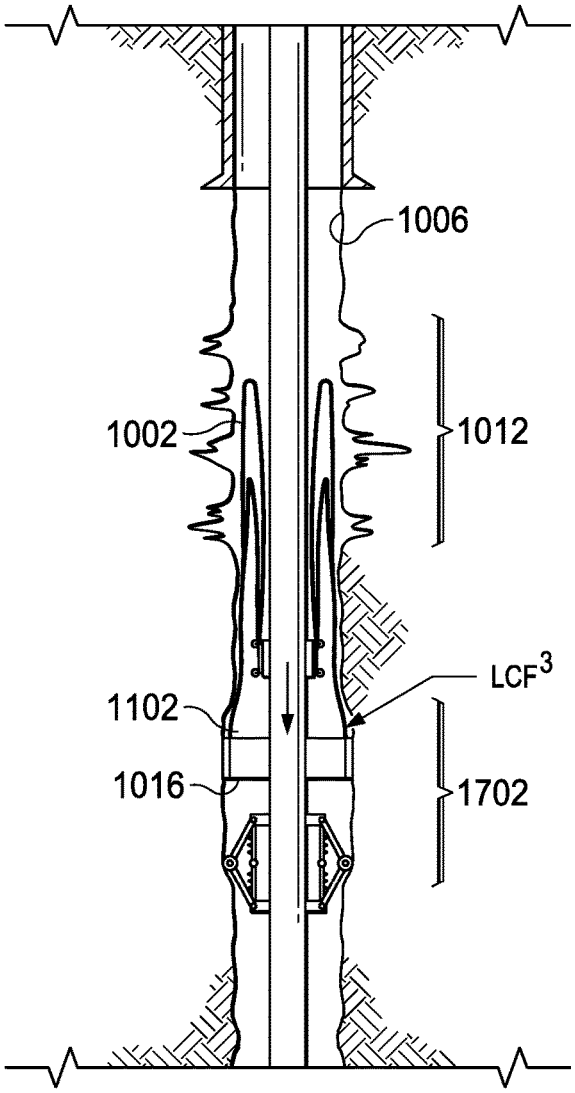
FIGS. 19-22 show stages of a method of the LCF deployment tool in FIG. 10.

As shown in FIG. 19, the command to radially expand the retention mechanism 1016 can include, for example, sending an electrical signal or dropping a ball to release the lock pin 1106 from the lock tube 1104 and radially expand the spiral spring 1102 (shown in FIGS. 10-12). When the spiral spring 1102 part of the retention mechanism 1016 is radially expanded to contact the under reamed section 1702, the spiral spring 1102 can be set in the under reamed section 1702. A first end of the LCF 1002 can move with the spiral spring 1102 while a second end of the LCF 1002 is wrapped around the spool 1026 of the LCF deployment tool 1000, such that the LCF 1002 can stretch across the radial spacing 1802 created between the spiral spring 1102 and spool 1026 when the spiral spring 1102 is set in the under reamed section 1702. Concurrently with expanding the spiral spring 1102, the underreamers 1040 can be retracted radially inward to the LCF deployment tool 1000, and the roller arms 1020 can be radially expanded to contact the wellbore 1006 wall.

Figure 20:
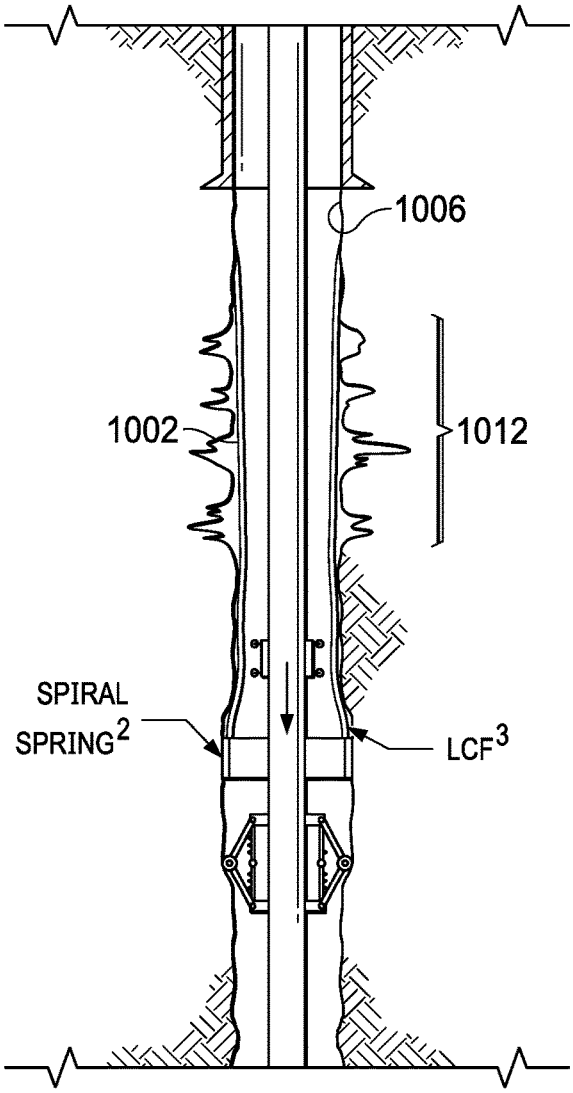

As shown in FIG. 20, the circulation of drilling fluid and paused LCF deployment tool 1000 rotation can continue for a time period sufficient to allow the LCF 1002 to fully spread over the lost circulation zone 1012 of the wellbore 1006.

Figure 21:
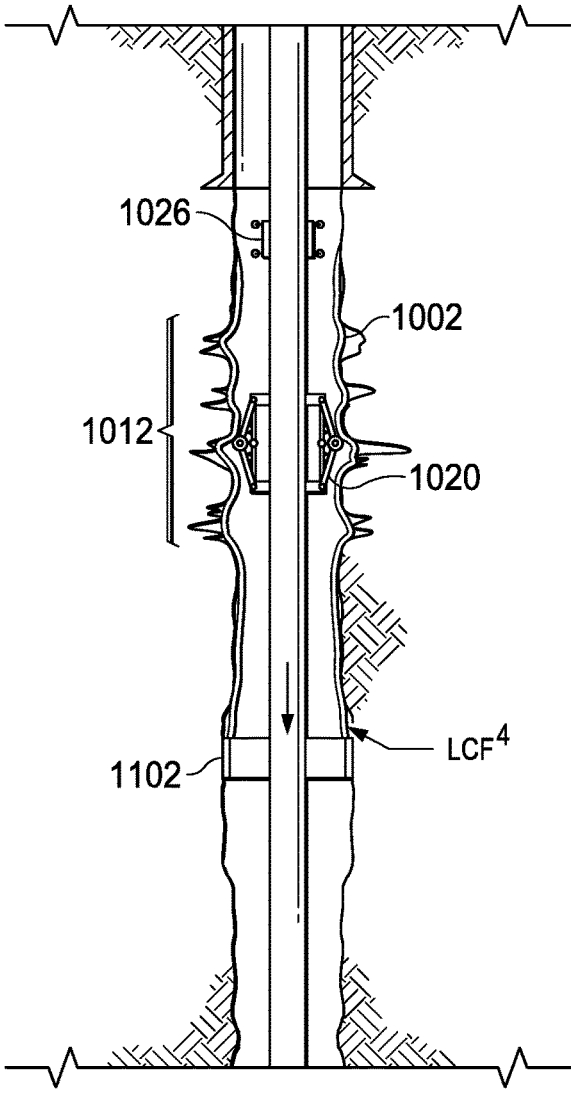

As shown in FIG. 21, after the LCF 1002 has been completely detached from the LCF deployment tool 1000 (the first end of the LCF 1002 being held by the radially expanded and detached spiral spring 1102 and the remaining portion of the LCF completely unwound from the spool 1026), and after the time period for allowing the LCF 1002 to spread over the lost circulation zone 1012 of the wellbore 1006, the LCF deployment tool 1000 can be moved in a direction toward the surface of the well to move the roller arms 1020 over the lost circulation zone 1012 of the wellbore 1006, thereby improving the LCF 1002 contact to the wellbore 1006.

Figure 22:
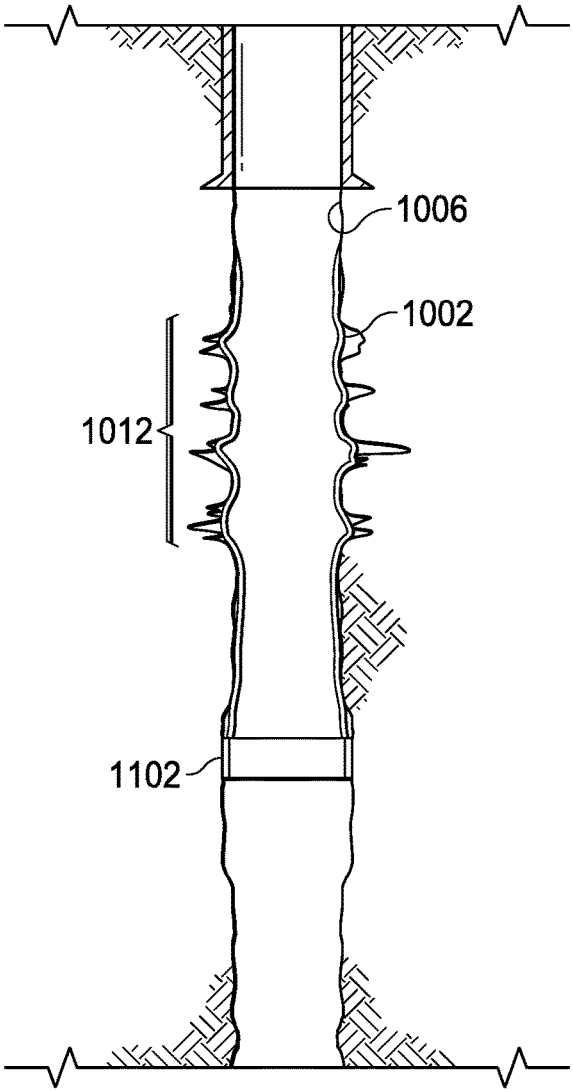

As shown in FIG. 22, after application of the LCF 1002 to the wellbore 1006 wall, the LCF deployment tool 1000 can be removed and/or drilling operations can continue, leaving the spiral spring 1102 and LCF 1002 lining the wellbore 1006 wall, and positive downhole pressure can be maintained.

The LCF deployment tool 1000 can deploy an LCF 1002 to a wellbore 1006 without detaching and leaving a portion of a retention mechanism (e.g., spiral spring 1102 in FIGS. 15-22) lining the wellbore 1006.

Figure 23:
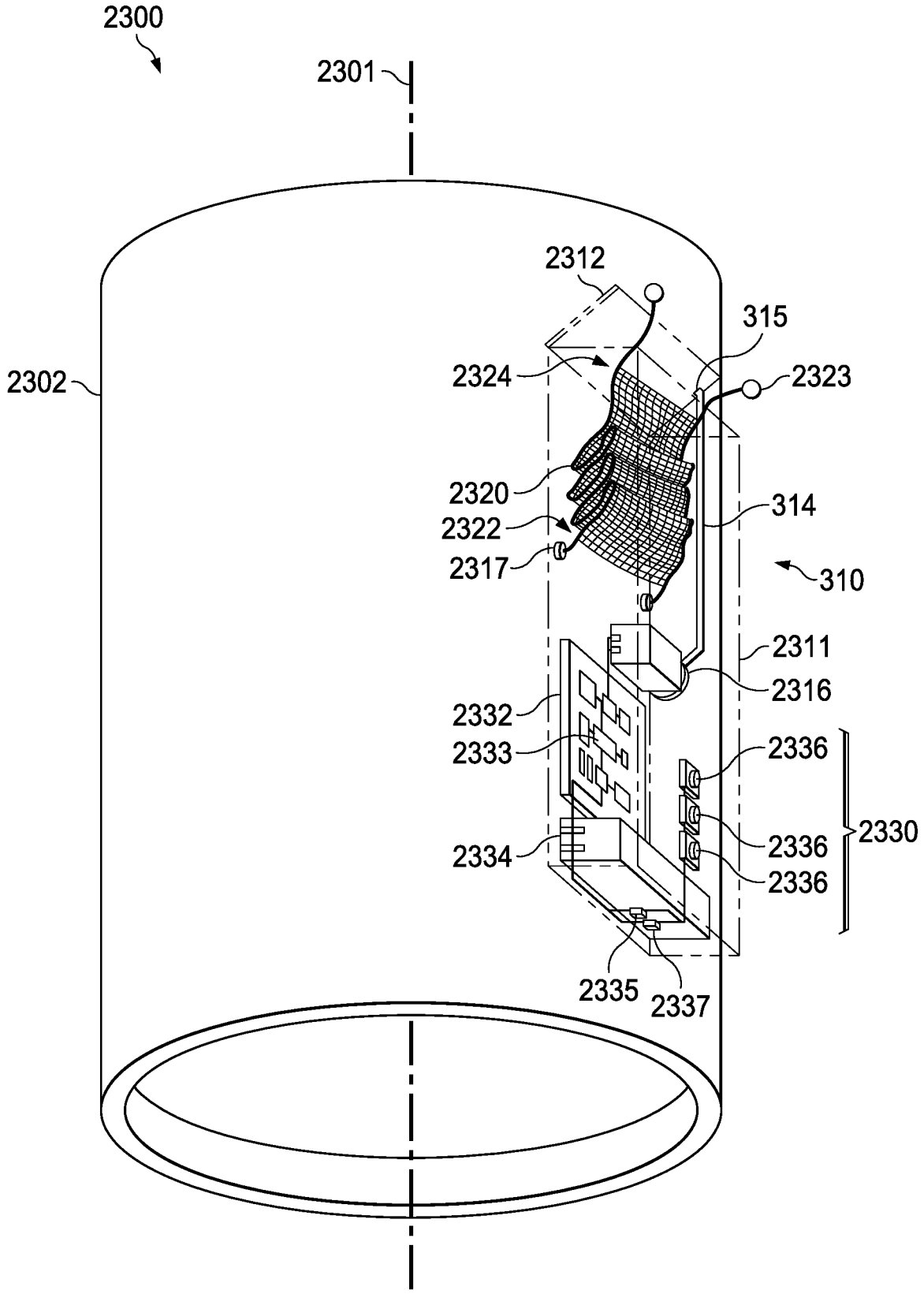
FIG. 23 a perspective view of an LCF deployment tool.

FIG. 23 shows an example of an LCF deployment tool 2300 that uses a different approach to deploying an LCF. The LCF deployment tool 2300 has a tubular body 2302, which can be part of a drill string or BHA or can be a tubular body 2302 disposed around a drill pipe, and has a longitudinal axis 301 around which the tubular body 2302 can rotate during drilling operations. Prior to sending the LCF deployment tool 2300 downhole, LCF 2320 can be compacted (e.g., folded) in and held by a retention mechanism 2310 disposed around the tubular body 2302. A single retention mechanism 2310 holding LCF 2320 surrounds the tubular body 2302. However, two or more retention mechanisms 2310 can hold compacted LCF 2320 disposed circumferentially around the tubular body 2302. Similar to spool rings 2235, the retention mechanisms 2310 can be configured such that the deployed LCF 2320 can overlap, thereby providing full circumferential coverage of the wellbore wall and lost circulation zone with the fabric.

The retention mechanism 2310 has a housing 211 containing the compacted LCF 2320, a gate 2312 providing access to inside the housing 2311, and a release system 2314 capable of holding the gate 2312 in a closed position and releasing the gate 2312 to an open position (as shown in FIG. 23). The housing 2311 can have solid walls, or can have slotted or otherwise apertured walls. The release system 2314 can include, for example, a lock 2315 that can be unlocked with an actuator 2316.

A first end 2322 of the LCF 2320 can be retained to the inside of the housing 2311 using an attachment piece 2317, such as, for example, magnets, a latch, a removable pin, or other type of attachment mechanism. A second end 2324 of the LCF 2320 can have one or more floats 2323 attached thereto. The floats 2323 can be made of buoyant material, such as foam or an enclosure of air or other gas.

A communication system 2330 can be provided in the same housing 2311 of the retention mechanism 2310, or a communication system 2330 can be provided in separated or partitioned housing, and can be in communication with the release system 2314. The communication system 2330 can include computing components capable of sending and/or receiving signals and processing instructions to operate the release system 2314. Optionally, the communication system 2330 can also include computing components for collecting and storing data from one or more sensor(s) 2336 provided on an outer surface of the communication system housing (where the communication system housing can be the same as or different than the retention mechanism housing 2311). Computing components can include, for example, at least one printed circuit board 2332, at least one microprocessor 2333 integrated with the printed circuit board 2332, and at least one power module 2334. The power module 2334 can be charged or recharged via a charging port 2335.

The communication system 2330 can also have one or more communication ports 2337, through which programmed instructions can be provided to the printed circuit board 2332 or sensing data from sensors 2336 can be downloaded.

The communication system 2330 can have one or more set of programmed instructions stored in a memory or other non-transitory computer-readable media that stores data (e.g., connected with the printed circuit board 2332), which can be accessed and processed by the microprocessor 2333. The programmed instructions can include, for example, instructions for sending or receiving signals and commands to operate the release system 2314 and instructions for collecting and storing data from one or more sensor(s) 336.

One or more sensors 2336 can be provided on an outer surface of the LCF deployment tool 2300 for taking property measurements (e.g., porosity, density, flow rate, temperature, pressure, etc.) of a surrounding wellbore. When the LCF deployment tool 2300 is sent down a wellbore, the sensors 2336 can take the selected property measurements of the surrounding wellbore, and the microprocessor 2333 can process and analyze the measurement readings to determine when the LCF deployment tool 2300 is near a loss zone section of the wellbore. Upon determining a location of a loss zone, the microprocessor 2333 can carry out programmed instructions for controlling the actuator 2316 to unlock the gate 2312 and release the LCF 2320 for patching the loss zone.

Figure 24:
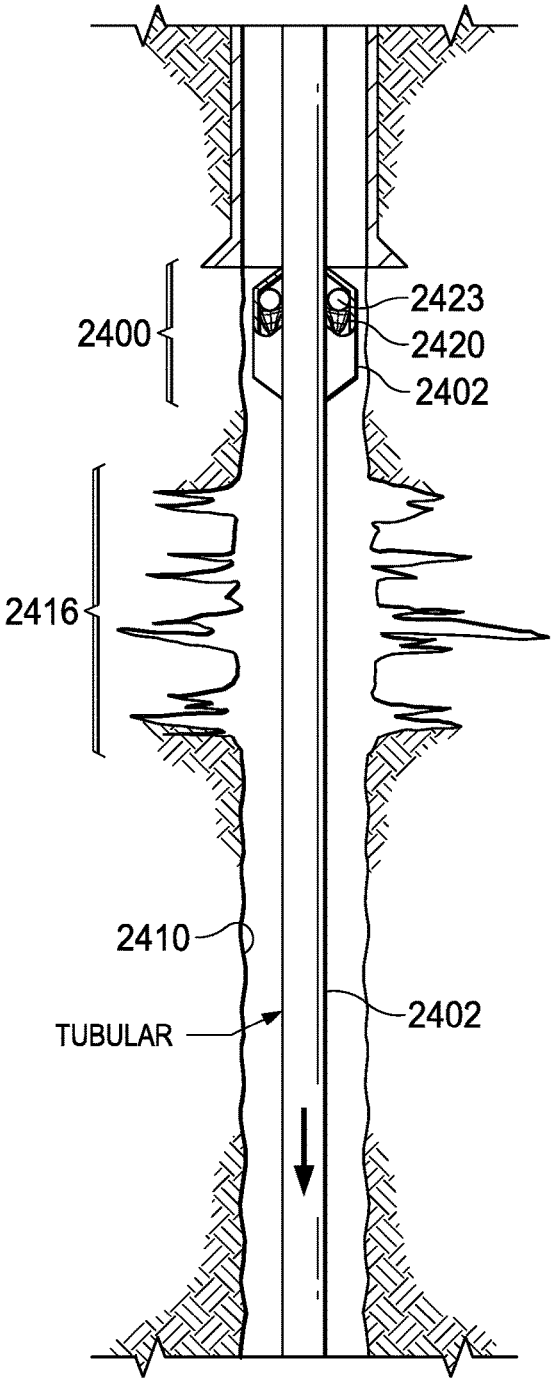
FIGS. 24-26 show stages of a method of the LCF deployment tool in FIG. 23.
Figure 25:
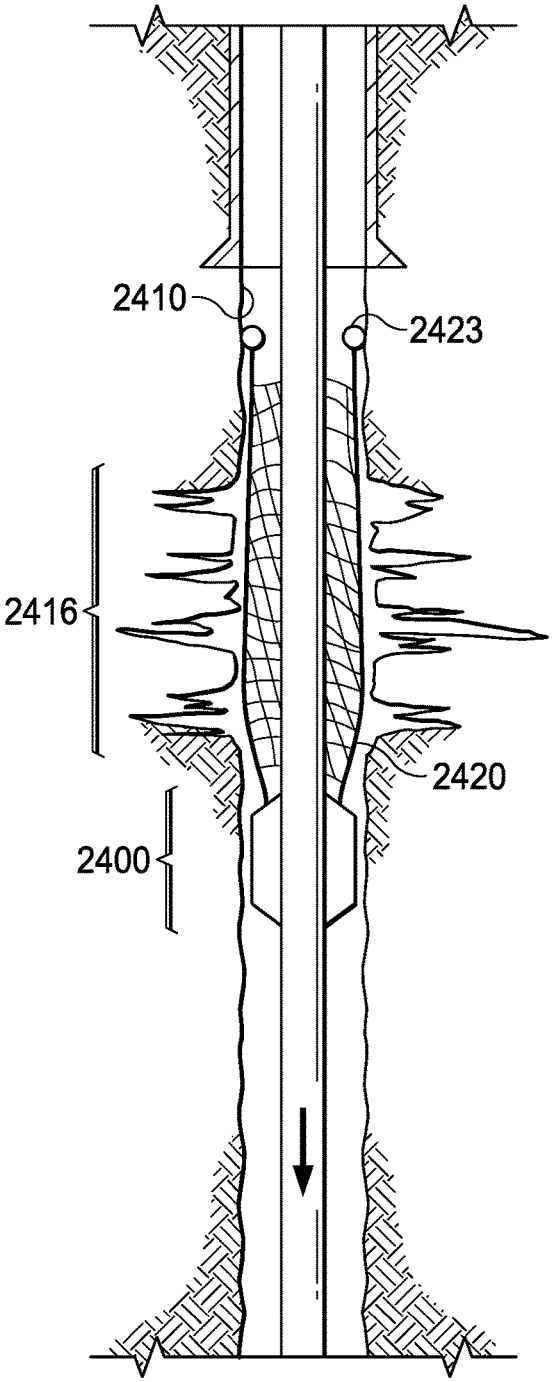
Figure 26:
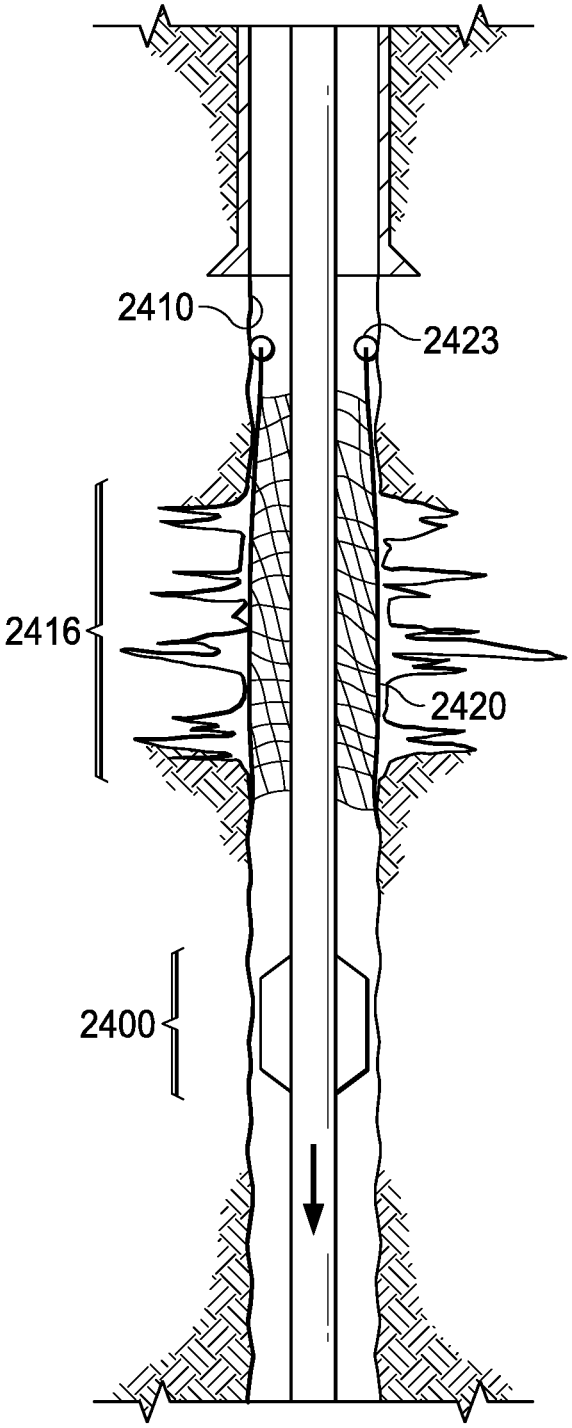

FIGS. 24-26 show an example method for deploying LCF from an LCF deployment tool 2400, similar to the one shown in FIG. 23, to patch a lost circulation zone 2416 of a wellbore 2410.

As shown in FIG. 24, the LCF deployment tool 2400 can be provided along a section of drill string 2402 and sent downhole during a drilling operation, drilling a wellbore 2410. A lost circulation zone 2416 can be determined along the open hole (uncased) portion of the wellbore 2410 and selected as a lost circulation zone 2416 to be covered with LCF 2420. For example, the lost circulation zone 2416 can be determined using one or more sensors disposed along an outer surface of the LCF deployment tool 2400, such as described above.

The LCF deployment tool 2400 can have multiple retention mechanisms 2402 disposed circumferentially around the tubular body of the LCF deployment tool 2400, where each retention mechanism 2402 houses a compacted LCF 2420. The LCF 2420 can have a first end attached to an interior part of the retention mechanism 2402 and at least one float 2423 attached to a second end of the LCF 2420.

As shown in FIG. 25, the LCF deployment tool 2400 can be positioned below (farther away from the surface of the well) the lost circulation zone 2416. A gate or latch holding the LCF 2420 compacted in the retention mechanisms 2402 can be opened to partially release the LCF 2420 from the retention mechanisms 2402. The LCF 2420 can be released from one retention mechanism 2402 of the LCF deployment tool 2400 or from multiple retention mechanisms 2402 at the same time.

Once the retention mechanism 2402 is opened or unlatched to partially release the LCF 2420, the floats 2423 attached at the second end of the LCF 2420 can float the LCF 2420 upwards (toward the surface of the well). The circulating drilling fluid can flow through the partially released LCF 2420 and push the LCF 2420 around the wellbore 2410. The differential pressure around the lost circulation zone 2416 can be utilized to press the LCF 2420 against the formation. A pre-defined time delay can be given to allow the LCF 2420 to fully spread out and cover the lost circulation zone 2416.

As shown in FIG. 26, after the time delay, the first end of the LCF 2420 can be detached from the retention mechanism 2402, such that the LCF 2420 is entirely detached from the LCF deployment tool 2400. Upon completely detaching the LCF 2420 from the LCF deployment tool 2400, drilling operations can continue. The LCF 2420 can be applied to and held in place along the lost circulation zone 2416 of the wellbore 2410, for example, by the circulating drilling fluid and the differential pressure between the mud column and lost circulation zone 2416. The LCF deployment tool 2400 can further include one or more roller arms that can expand radially outward from the LCF deployment tool body to roll over and press the LCF 2420 to the wellbore 2410.

While the disclosure includes a limited number of embodiments, those skilled in the art, having benefit of this disclosure, will appreciate that other embodiments can be devised which do not depart from the scope of the present disclosure. Accordingly, the scope should be limited only by the attached claims.

What is claimed is:

1. A lost circulation system configured to reduce losses of drilling fluid in a lost circulation zone of a wellbore, the system comprising:

a sheet of a lost circulation fabric, wherein the sheet of the lost circulation fabric is a material whose structure and composition limit a flow of drilling fluid through the sheet, the sheet of lost circulation material having a maximum thickness of 1 millimeter, a length of one foot to one thousand feet, and a width of one inch to twenty inches, wherein the sheet is formed of material having:

an elastic modulus between 1300 to 2000 MPa;

a tensile strength between 10 and 10,000 megapascals (MPa);

a surface roughness between 0.025 micrometers to 1 millimeter of 1% loss/° C. starting at 350° C.;

a toughness between 1 and 100 kilojoules per square meter (kJ/m$^2$); and a thermal stability of 1% loss/° C. starting at 350° C.; and particles of a second lost circulation material;

wherein the sheet of the lost circulation fabric defines holes extending through the sheet.

2. The system of claim 1, wherein the sheet is a polymeric membrane.

3. The system of claim 2, wherein the sheet further comprises openings, each opening having a major dimension (K) between 0.005 millimeters to 5 millimeters, and the openings having a spacing (S) between adjacent openings of between 0.0025 millimeters and fifty millimeters.

4. The system of claim 1, wherein the sheet is a fabric woven from threads of a first material and a second material.

5. The system of claim 4, wherein a composite of the first material is a polymer and the second material is a polymer.

6. The system of claim 4, wherein the first material is a polymer and the second material is non-polymer.

7. The system of claim 1, wherein the sheet comprises: a first strip of fabric material; a second strip of fabric material proximal and parallel to the first strip of fabric material; a third strip of fabric material interwoven between first strip of fabric material and the second strip of fabric material; and a fourth strip of fabric material interwoven between the first strip of fabric material and the second strip of fabric material, parallel to the third strip of fabric material, and interwoven opposite the third strip of fabric material.

8. The system of claim 7, wherein the first strip of fabric material is spaced from the second strip of fabric material and the third strip of fabric material is spaced from the second strip of fabric material by a first spacing (K) between 0.005 millimeters and 5 millimeters.

9. The system of claim 8, wherein the first strip of fabric material, the second strip of fabric material, the third strip of fabric material, and the fourth strip of fabric material have a width (W) between 0.0025 millimeters and fifty millimeters.

* * * * *